US008251000B2

(12) United States Patent
Fukao

(10) Patent No.: US 8,251,000 B2
(45) Date of Patent: Aug. 28, 2012

(54) SPOOL HOLDER AND SEWING MACHINE PROVIDED THEREWITH

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 136 days.

(21) Appl. No.: 12/830,776

(22) Filed: Jul. 6, 2010

(65) Prior Publication Data

US 2011/0011318 A1 Jan. 20, 2011

(30) Foreign Application Priority Data

Jul. 15, 2009 (JP) ..... 2009-166769

(51) Int. Cl.
*B65H 59/00* (2006.01)

(52) U.S. Cl. ..... 112/270

(58) Field of Classification Search ..... 112/270, 112/258, 259, 302, 279, 255; 242/169, 170, 242/171, 118
See application file for complete search history.

(56) References Cited

U.S. PATENT DOCUMENTS

| | | | | |
|---|---|---|---|---|
| 1,730,431 | A * | 10/1929 | Keefer | 242/129.8 |
| 2,940,685 | A * | 6/1960 | Glass | 242/139 |
| 4,351,458 | A * | 9/1982 | Wolfe | 223/106 |
| 5,063,866 | A * | 11/1991 | Jimenez et al. | 112/302 |
| 7,114,455 | B2 * | 10/2006 | Prufer et al. | 112/302 |
| 2011/0011318 | A1 | 1/2011 | Fukao | |
| 2011/0011319 | A1 | 1/2011 | Fukao | |

FOREIGN PATENT DOCUMENTS

| | | |
|---|---|---|
| JP | A-56-73765 | 6/1981 |
| JP | U-58-98074 | 7/1983 |
| JP | U-60-27877 | 2/1985 |
| JP | U-60-30779 | 3/1985 |
| JP | U-05-44073 | 8/1993 |
| JP | U-06-036585 | 5/1994 |
| JP | U-06-046676 | 6/1994 |
| JP | A-6-312073 | 11/1994 |
| JP | U-06-081478 | 11/1994 |
| JP | A-8-71278 | 3/1996 |
| JP | A-2000-008265 | 1/2000 |
| JP | A-2000-126487 | 5/2000 |
| JP | A-2000-126488 | 5/2000 |

(Continued)

OTHER PUBLICATIONS

Mar. 8, 2011 Office Action issued in Japanese Patent Application No. 2009-071927 (with translation).

(Continued)

*Primary Examiner* — Tejash Patel
(74) *Attorney, Agent, or Firm* — Oliff & Berridge, PLC

(57) ABSTRACT

A spool holder includes a spool holder base to which a plurality of thread spools is attachable, and a support base having a pivoting member. The spool holder base includes a first spool holder base, a second spool holder base continuous to the other end of the first base and a connection connecting the first and second bases. The spool holder further comprises a thread guide mechanism. The divided spool holder base is switchable between a storage position where the spool holder bases are adjacent and a use position where the first base is swung about the pivoting member and the second base is swung so that the spool holder bases are spread so as to be nonparallel to each other.

4 Claims, 14 Drawing Sheets

FOREIGN PATENT DOCUMENTS

| | | |
|---|---|---|
| JP | A-2004-242980 | 9/2004 |
| JP | A-2004-261413 | 9/2004 |
| JP | A-2006-061179 | 3/2006 |
| JP | A-2006-193240 | 7/2006 |
| JP | U-3138430 | 12/2007 |
| JP | A-2010-220846 | 10/2010 |
| JP | A-2011-19699 | 2/2011 |
| JP | A-2011-019700 | 2/2011 |

OTHER PUBLICATIONS

Apr. 19, 2011 Office Action issued in Japanese Patent Application No. 2009-166770 (with translation).

* cited by examiner

SPOOL HOLDER AND SEWING MACHINE PROVIDED THEREWITH

CROSS-REFERENCE TO RELATED APPLICATIONS

This application is based upon and claims the benefit of priority from the prior Japanese Patent Application No. 2009-166769 filed on Jul. 15, 2009, the entire contents of which are incorporated herein by reference.

BACKGROUND

1. Technical Field

The present disclosure relates to a spool holder including a spool holder base to which a plurality of thread spools is attachable and a sewing machine provided with the spool holder.

2. Related Art

Threads drawn from a plurality of thread spools on a spool holder base respectively are guided by a thread guide mechanism at a location higher than the thread spools in conventional sewing machines provided with a spool holder of the aforementioned type. The threads guided by the thread guide mechanism are passed through respective predetermined thread supply paths in the sewing machine. The threads along the thread supply paths are routed through thread tensioners, thread take-up levers and the like, being supplied to needles, respectively.

The spool holder of the above-described type is disposed, for example, above an arm of the sewing machine and constructed as follows. The spool holder includes a spool holder base which is formed into a horizontally long rectangular shape in a planar view. Five thread spools are placed on the front of the spool holder base so as to be arranged right and left, and four thread spools are placed on the rear of the spool holder base so as to be arranged right and left. Thus, a relatively larger number of thread spools can be placed on the spool holder base. However, the spool holder base juts right and left to a large extent. As a result, there is a problem that the spool holder base occupies a large space when the number of thread colors in the sewing of an embroidery pattern is less than 9 or when the sewing machine is kept in a storage space.

Another type of spool holder has been provided which includes a pair of spool holder bases mounted via a pair of pivot shafts on a support base. Three thread spools are placed on each spool holder base. The paired spool holder bases are switched by the pivot shafts between a use position where the rears of the spool holder bases are spread into a V-shape in a planar view and a storage position where the spool holder bases are closed so as to be substantially in parallel with each other. Since the spool holder bases take the V-shape at the use position, the spool holder can overcome the aforementioned problem of the storage space with the right-left dimension being reduced.

However, the thread spools are arranged in parallel or in the V-shape in the front-rear direction when the spool holder bases are located at the storage position or the use position. Accordingly, the user reaches his or her arm in the back of each spool holder to attach and detach the thread spool, for example, when the thread spools located in the back of each spool holder base are to be replaced. As a result, when each spool holder base is constructed so that a larger number of thread spools, for example, four or more thread spools can be placed thereon, the user located in the front side of the sewing machine has a great difficulty in the replacement of thread spools located in the back of each spool holder base. This results in an adverse effect on the working efficiency.

SUMMARY

Therefore, an object of the disclosure is to provide a spool holder which can allow the spool holder base to be stored in a compact state and can render the replacement of thread spools easier and further to provide a sewing machine equipped with the spool holder.

The present disclosure provides a spool holder comprising a spool holder base to which a plurality of thread spools is attachable; and a support base having a pivoting member which supports the spool holder base so that the spool holder base is swingable in a horizontal plane. The spool holder base includes two divided spool holder bases each of which is divided into a plurality of portions and includes a first spool holder base which has one end that is pivotally mounted on the pivoting member so that the first spool holder base is swingable and on which a plurality of thread spools is placed so as to be horizontally lined; a second spool holder base which is continuous to the other end of the first spool holder base and on which a plurality of thread spools is placed so as to be horizontally lined, the second spool holder base having two ends; and a connection which connects one end of the second spool holder base to the other end of the first spool holder base so that the second spool holder base is swingable. The spool holder further comprises a thread guide mechanism including a thread guide member having a plurality of thread guide portions that are configured to guide, at a location higher than the thread spools, threads extending from the respective thread spools and which are lined substantially in a horizontal direction, and a support pillar that is configured to support the thread guide member on the support base. The two divided spool holder bases are disposed bilaterally symmetric about the support pillar. Each divided spool holder base is switchable between a storage position where the first and second spool holder bases are adjacent to each other so as to be substantially in parallel to each other in a lengthwise direction and a use position where the first spool holder base is swung from the storage position about the pivoting member and the second spool holder base is swung about the connection so that the first and the second spool holder bases are spread so as to be nonparallel to each other. The divided spool holder bases are constructed so that the first and second spool holder bases are arranged into an M-shape when being located at the use position.

DETAILED DESCRIPTION

First Example

Figure 1:
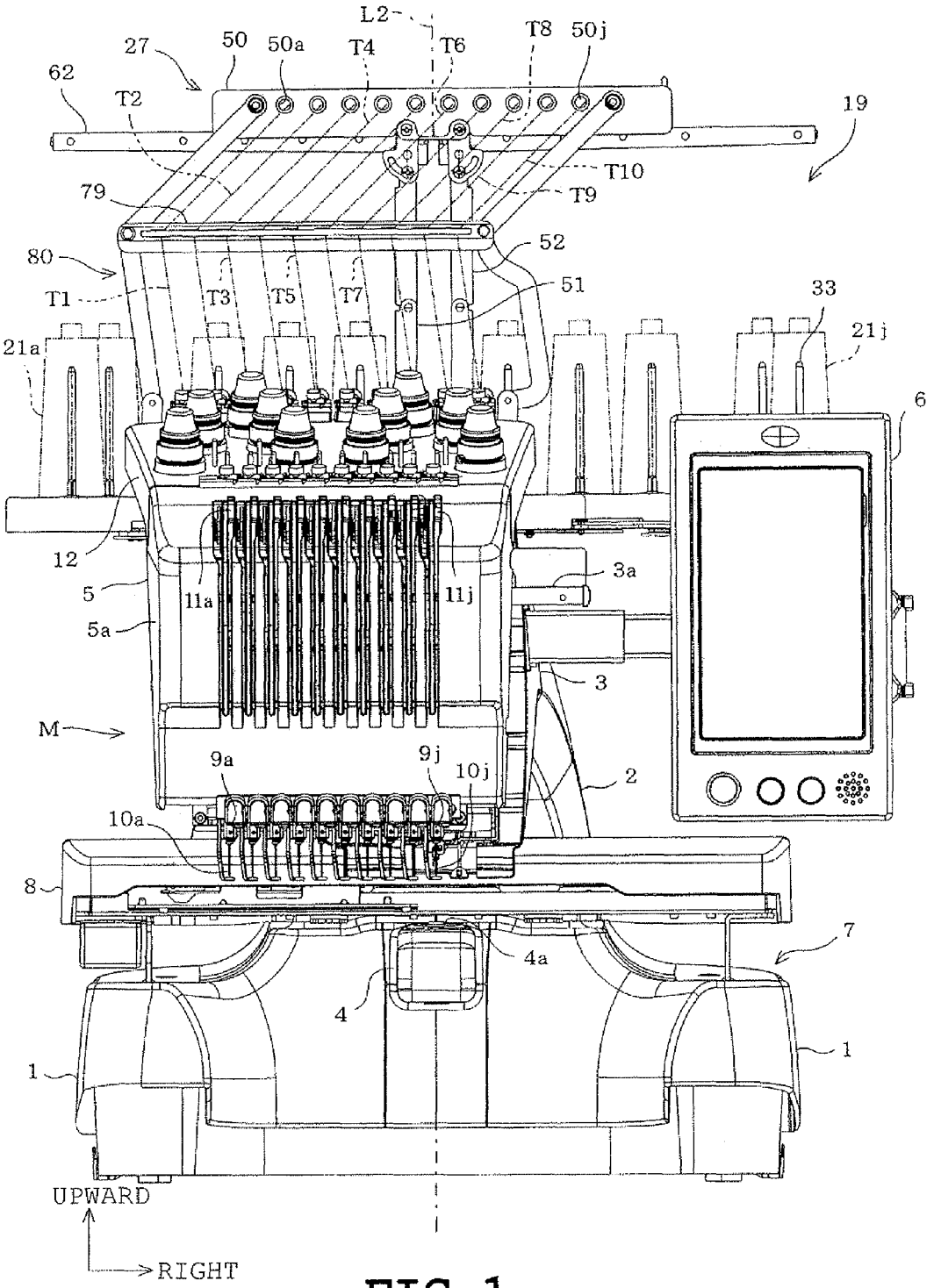
FIG. 1 is a front view of a multi-needle sewing machine provided with a spool holder in accordance with one example.

A first example applied to the multi-needle embroidery sewing machine will be described with reference to FIGS. 1 to 15. Referring to FIG. 1, an overall multi-needle sewing machine M serving as the multi-needle embroidery sewing machine is shown as viewed at the front side or the user side. In the following description, the user is assumed to be located at the front of the multi-needle sewing machine M and the opposite side of the sewing machine will be referred to as "the rear." Furthermore, the front-rear direction will be referred to as "Y direction" and the direction perpendicular to the Y direction will be referred to as "X direction."

Figure 2:
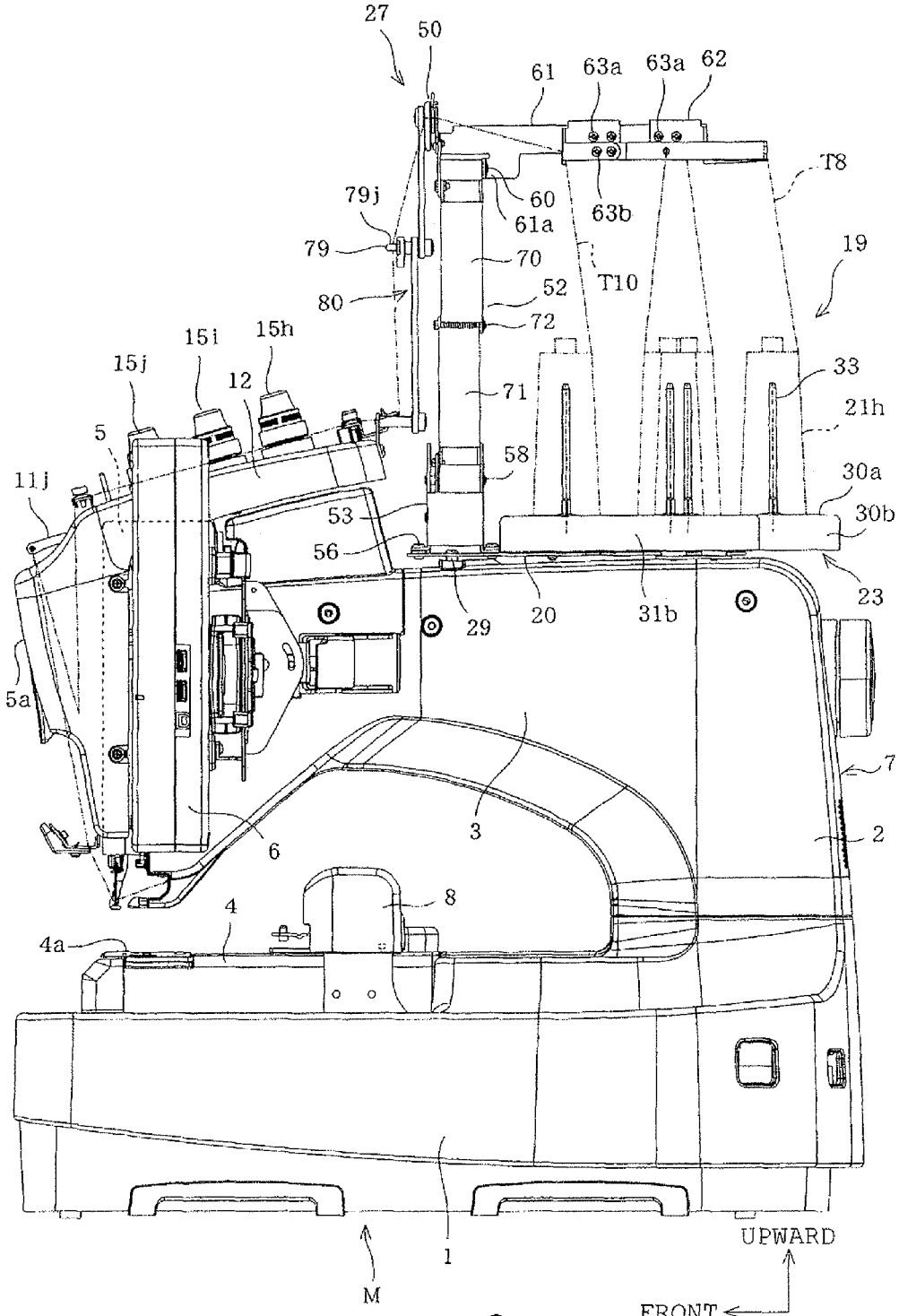
FIG. 2 is a right side view of the multi-needle sewing machine.
Figure 3:
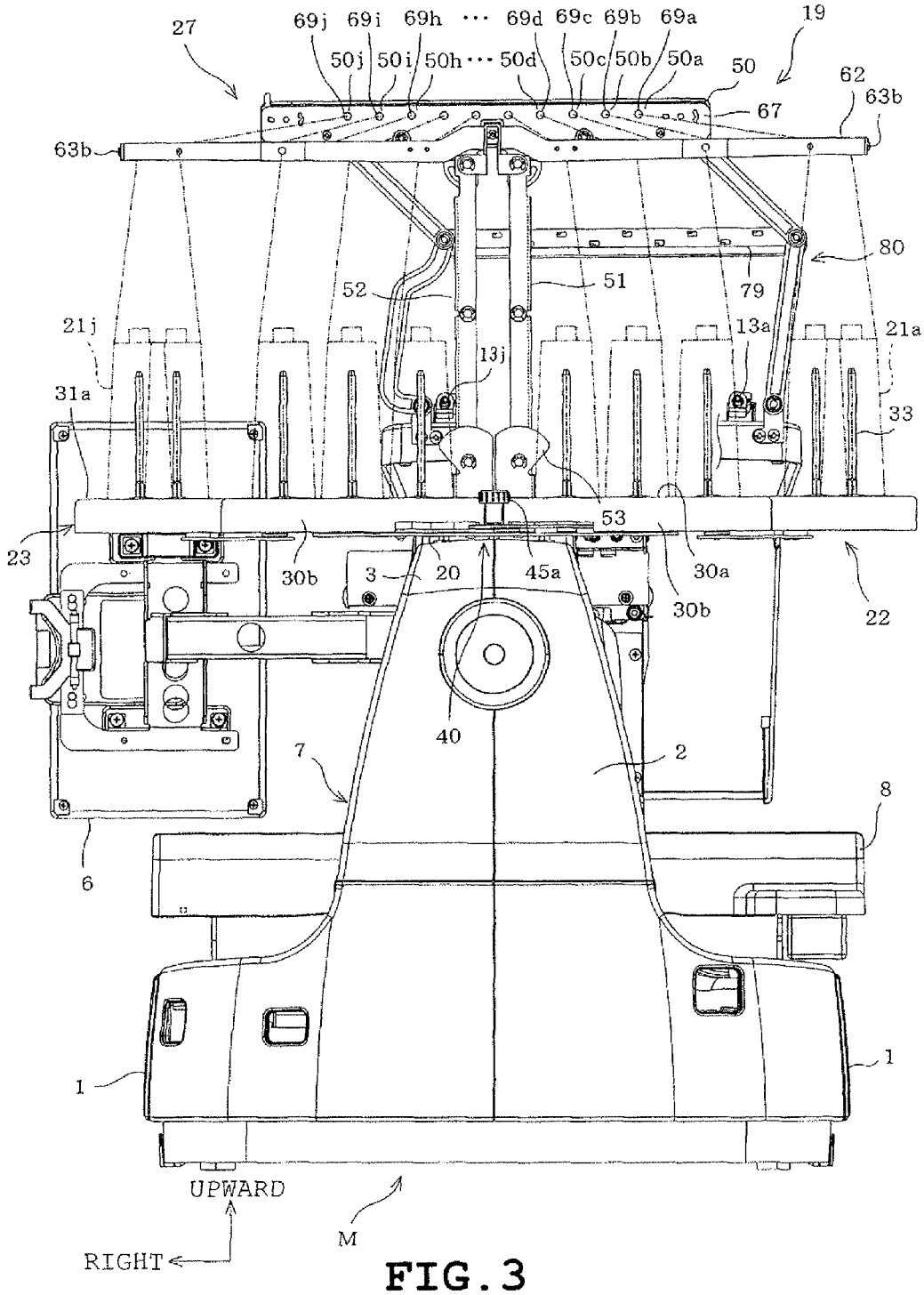
FIG. 3 is a rear view of the multi-needle sewing machine.

The multi-needle sewing machine M includes a pair of right and left legs 1 supporting the overall sewing machine, a pillar 2 standing on rear ends of the legs 1, an arm 3 extending frontward from an upper part of the pillar 2, a cylinder bed 4 extending frontward from a rear end of the pillar 2, and a needle bar case 5 mounted on a front end of the arm 3, as shown in FIGS. 1 to 3. The legs 1, pillar 2, arm 3 and cylinder bed 4 are formed integrally with one another into a sewing machine body 7. A control unit (not shown) controlling the overall multi-needle sewing machine M, an operation panel 6 and the like are provided at the sewing machine body 7 side. A needle plate 4*a* is mounted on an upper surface of the cylinder bed 4. The needle plate 4*a* is formed with a needle hole (not shown) serving as a needle position for needles 10*a* to 10*j* as will be described later.

A carriage 8 directed in the right-left direction is disposed above the legs 1. A frame bracket (not shown) is mounted on the front side of the carriage 8. An X-direction drive mechanism (not shown) is provided inside the carriage 8 to drive the frame bracket in the X direction (the right-left direction). A Y-direction drive mechanism (not shown) is provided inside the legs 1 to drive the carriage 8 in the Y direction (the front-back direction). A workpiece cloth on which embroidery is to be sewn is held by a generally rectangular embroidery frame (not shown). The embroidery frame which holds the workpiece cloth is mounted on the frame bracket. The embroidery frame is moved in the Y direction in synchronization with the carriage 8 by the Y-direction drive mechanism or in the X direction together with the frame bracket by the X-direction drive mechanism. Thus, the workpiece cloth is fed by the movement of the embroidery frame.

Figure 5:
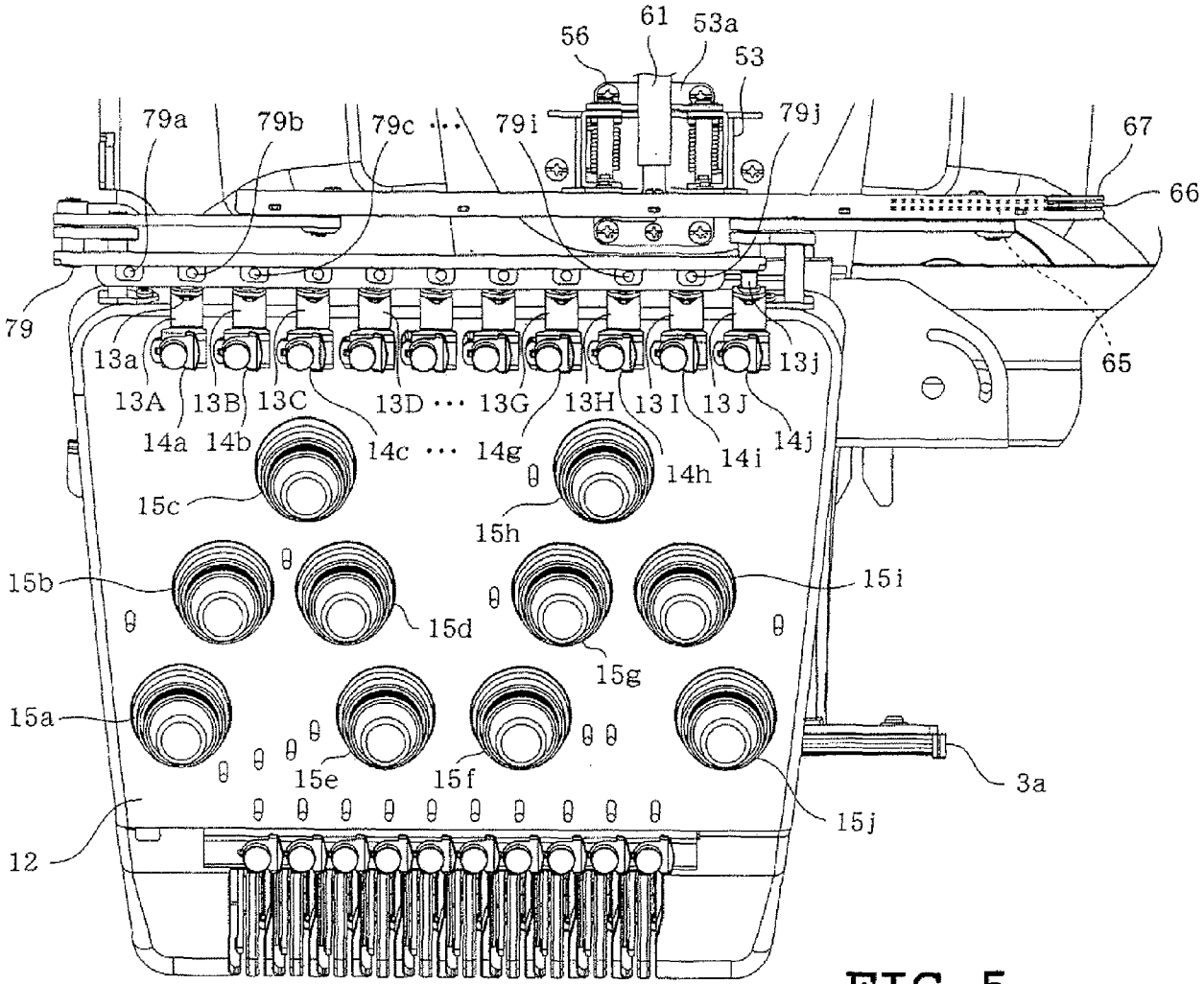
FIG. 5 is a plan view of a thread tension bracket.

Ten needle bars 9*a* to 9*j* are arranged in the right-left direction so as to extend in the up-down direction in the needle bar case 5 and supported so as to be movable upward and downward. Ten needles 10*a* to 10*j* are attached to lower ends of the needle bars 9*a*-9*j* respectively. Ten thread take-up levers 11 corresponding to the respective needle bars 9*a*-9*j* are also provided in the needle bar case 5 so as to be movable upward and downward. A cover 5*a* made of a synthetic resin is mounted on a front side of the needle bar case 5. A thread tension bracket 12 is mounted on the upper surface of the needle bar case 5 so as to be inclined forwardly downward and so as to be continuous to the upper end of the cover 5*a*. Ten cylindrical thread introducing members 13A to 13J are aligned on a rear end of the thread tension bracket 12 in the right-left direction as shown in FIG. 5. Ten auxiliary thread guides 14*a* to 14*j* are provided on the front sides of the thread entrances 13*a*-13*j* respectively. Ten thread tensioners 15*a* to 15*j* are mounted on the thread tension bracket 12 to adjust tensions of needle threads supplied to the needles 10*a*-10*j* respectively.

A guide rail 3*a* is provided on a front end of the arm 3 so as to extend in the right-left direction as shown in FIG. 1. The needle bar case 5 is supported on the guide rail 3*a* so as to be slid in the X direction or the right-left direction along the guide rail 3*a*. A needle bar case moving mechanism (not shown) is provided in the arm 3 for moving the needle bar case 5 in the X direction. A needle bar case moving motor (not shown) serves as a drive source for the needle bar case moving mechanism. A sewing machine motor (not shown) is provided in the pillar 2.

Upon drive of the needle bar case moving motor, one of ten sets of the needle bars 9*a*-9*j* and the thread take-up levers 11*a* to 11*j* is selectively switched to the needle position. The switched set of the needle bar and the thread take-up lever is synchronously moved upward and downward by the drive of the sewing machine motor 16. The cylinder bed 4 has a front end on which a rotating hook (not shown) is provided. Embroidery stitches are formed on the workpiece cloth in cooperation of the needle bar and the rotating hook.

Figure 4:
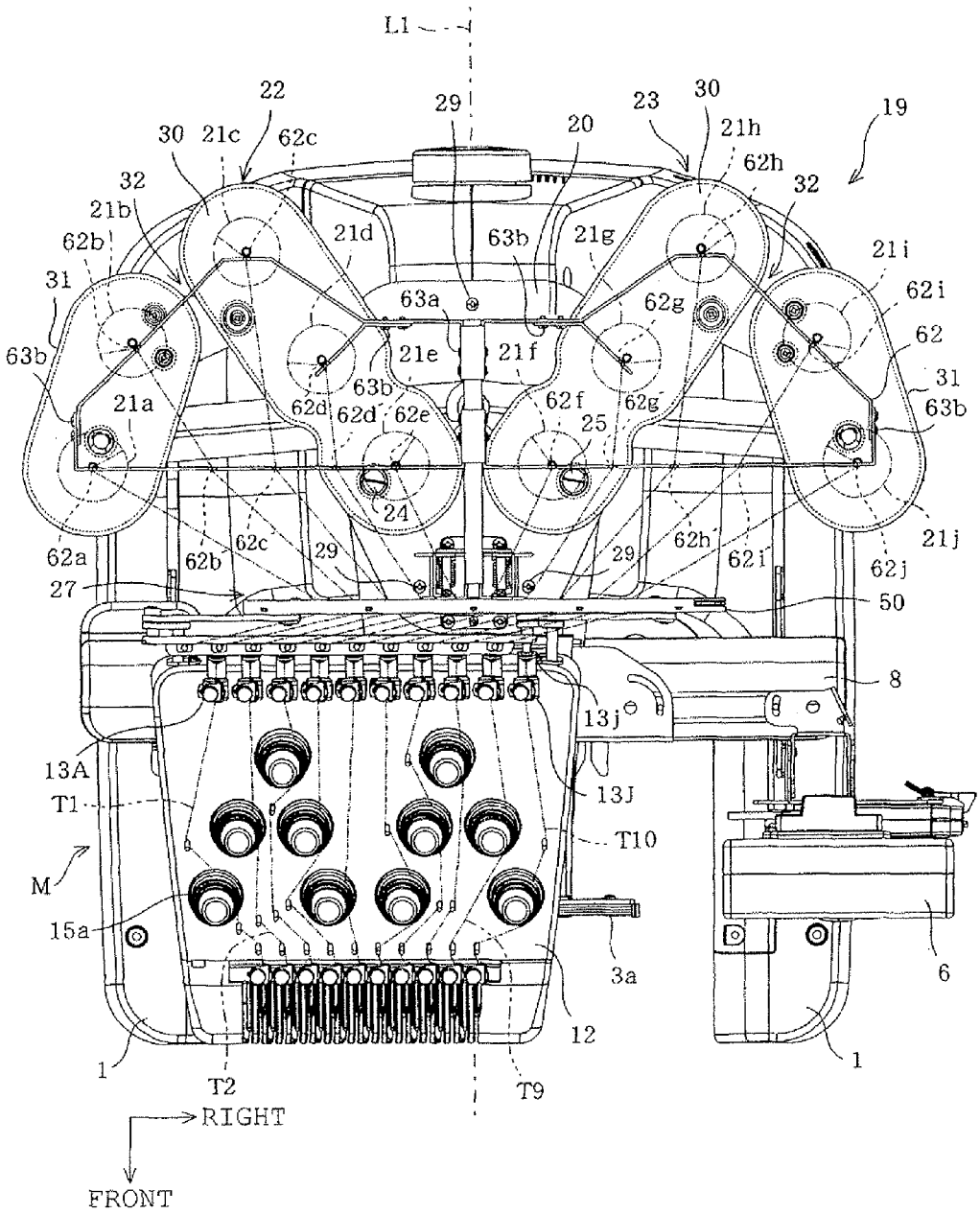
FIG. 4 is a plan view of the multi-needle sewing machine.

A spool holder 19 provided on the upper surface side of the sewing machine body 7 will now be described. The spool holder 19 includes a flat plate-shaped support base 20 disposed on the upper surface of the arm 3, a pair of divided spool brackets 22 and 23 serving as divided spool holder bases, a pair of support shafts 24 and 25 and a thread guide mechanism 27, as shown in FIGS. 2 to 4. For example, ten thread spools 21*a* to 21*j* are placed on the divided spool brackets 22 and 23 each of which is divided into two parts. The divided spool brackets 22 and 23 are mounted on the support base 20 by the support shafts 24 and 25 so as to be swingable in a horizontal plane.

Figure 8:
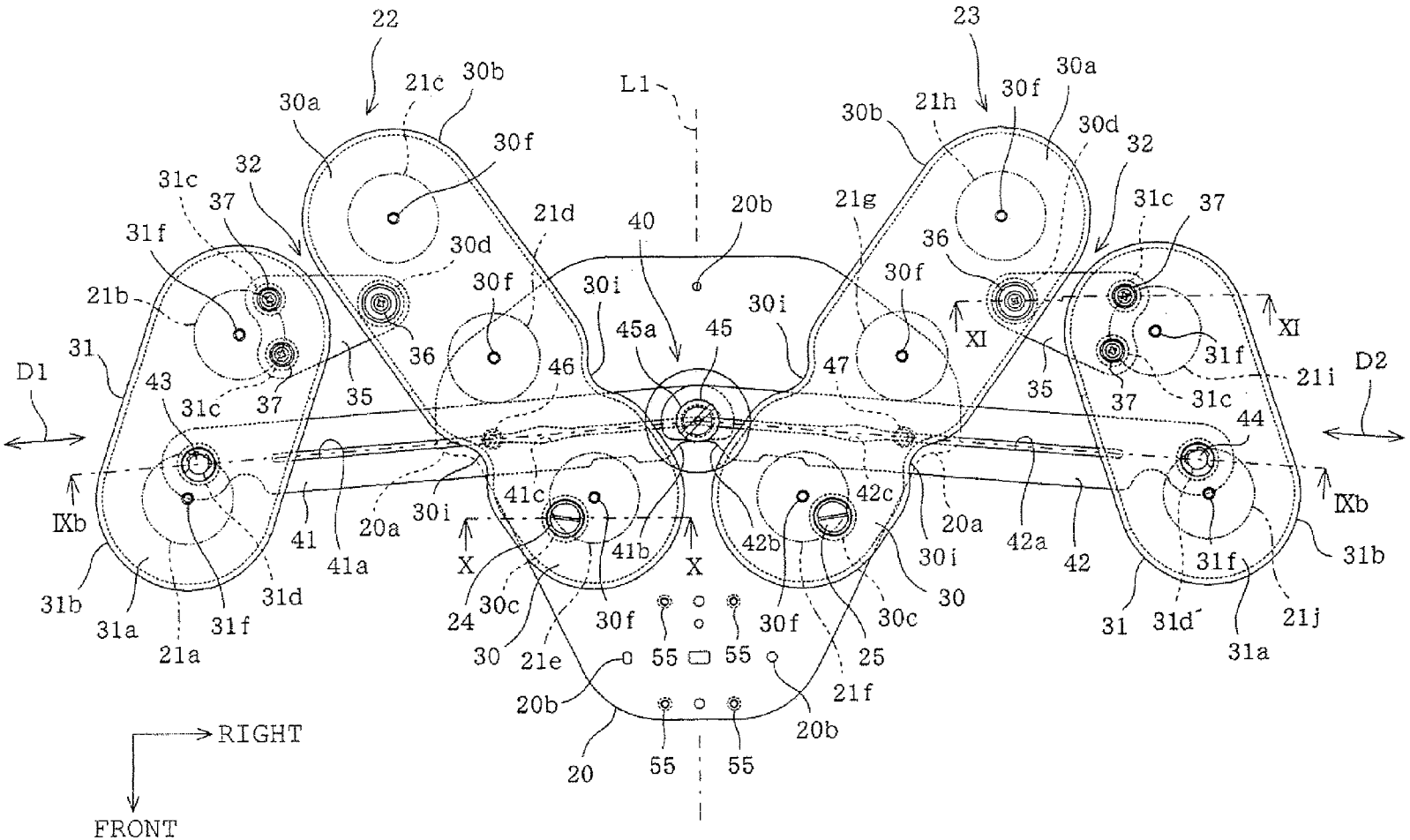
FIG. 8 is a plan view of the spool holder in the case where the divided spool holder base is located at a use position with the thread guide mechanism being eliminated.

The support base 20 comprises a metal plate and has a rear half which juts right and left as viewed on a planar view, thereby to be formed into a pair of juts 20*a*, as shown in FIG. 8. The support base 20 has three screw holes 20*b* formed in front and rear portions thereof. The support base 20 is fixed to the arm 3 by screws 29 (see FIG. 4) inserted through the respective screw holes 20*b* so as to be horizontal along the upper surface of the arm 3.

The paired spool brackets 22 and 23 are switched by the pivot shafts 24 and 25 between a use position (see FIGS. 4 and 8) where the spool brackets 22 and 23 are spread into a general M-shape as viewed on a planar view and a storage position (see FIGS. 15 and 16) where the spool brackets 22 and 23 are closed from the use position there by to be adjacent to each other substantially in a parallel disposition. The divided spool brackets 22 and 23 have the same structure and are disposed bilaterally symmetrically about the line L1 serving as an axis of symmetry while divided support pillars 51 and 52 serving as support pillars of the thread guide mechanism 27 are interposed therebetween. The left divided spool bracket 22 will mainly be described in the following.

Figure 9A:
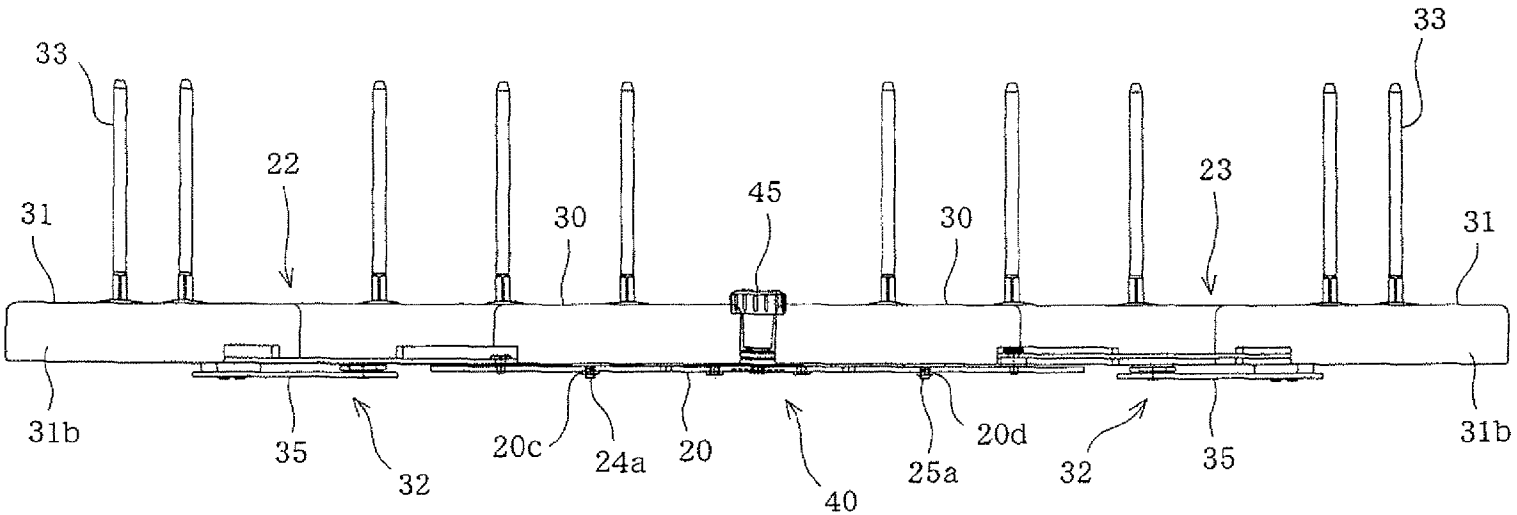
FIG. 9A is a front of the spool holder.
Figure 10:
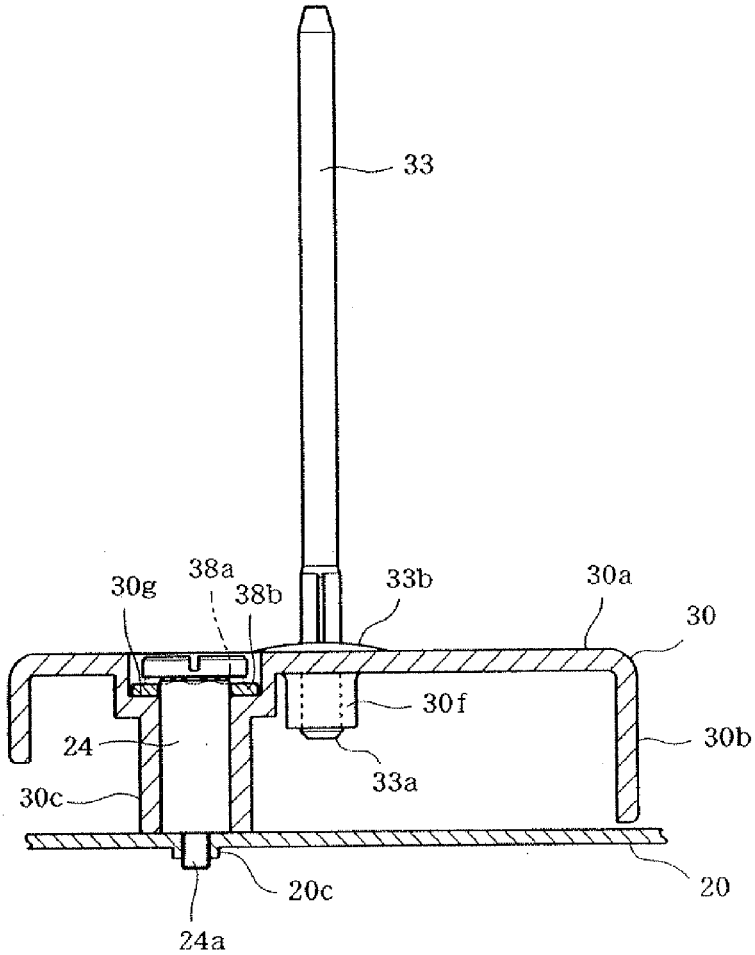
FIG. 10 is an enlarged section taken along line X-X in FIG. 8.
Figure 11:
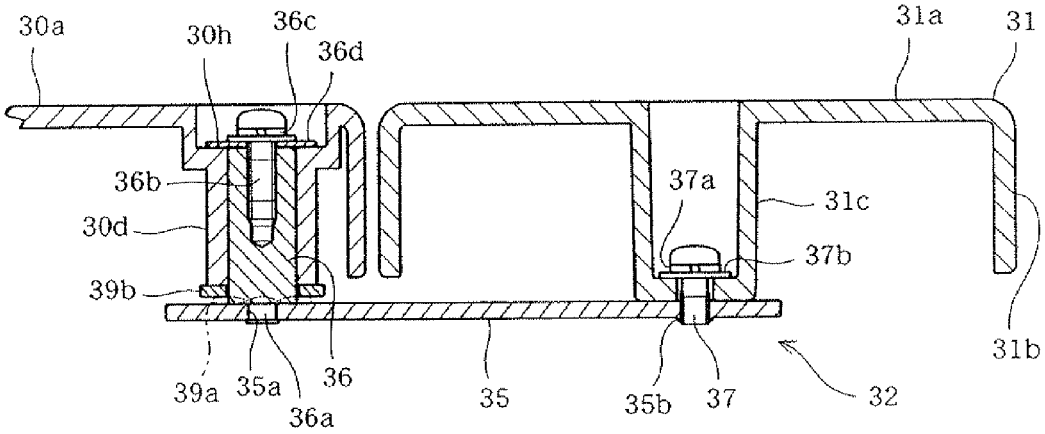
FIG. 11 is an enlarged section taken along line XI-XI in FIG. 8.

The divided spool bracket 22 has first and second spool brackets 30 and 31 both of which are made of a synthetic resin and serve as first and second spool holder bases respectively, and a connecting part 32 connecting both spool brackets 30 and 31 as shown in FIGS. 8 and 9A. More specifically, the first spool bracket 30 has a generally oval upper surface 30*a* as viewed in a plan view and a peripheral wall 30*b* extending along a peripheral edge of the upper surface 30*a*. The upper surface 30*a* and the peripheral wall 30*b* are formed integrally with the first spool bracket 30. The upper surface 30*a* has three pin holes 30*f* formed at predetermined intervals, for example, and spool pins 33 (see FIG. 10) are inserted into the pin holes 30*f* respectively as will be described later. Three thread spools 21*c*, 21*d* and 21*e* are placed on the respective spool pins 33 substantially in a straight arrangement so as to be horizontally lined, for example. The upper surface 30*a* has one or a front end formed with a pivot shaft hole 30*c* through which the pivot shaft 24 is inserted, as shown in FIG. 8. The upper surface 30*a* has the other or a rear end formed with a connecting hole 30*d* to which the connecting part 32 is connected. The substantially cylindrical pivot shaft hole 30*c* has a stepped portion 30*g* at the upper surface 30*a* side and is formed so as to protrude downward from the upper surface 30*a*, as shown in FIG. 10. The connecting hole 30*d* as shown in FIG. 11 also has a stepped portion 30*h* at the upper surface 30*a* side and is formed so as to protrude downward into a stepped cylindrical shape, in the same manner as the pivot shaft hole 30*c*. Furthermore, the first spool bracket 30 has an outer periphery formed with a pair of escape portions 30*i* which are located in a front part thereof and recessed inward into an embayed shape.

Figure 13A:
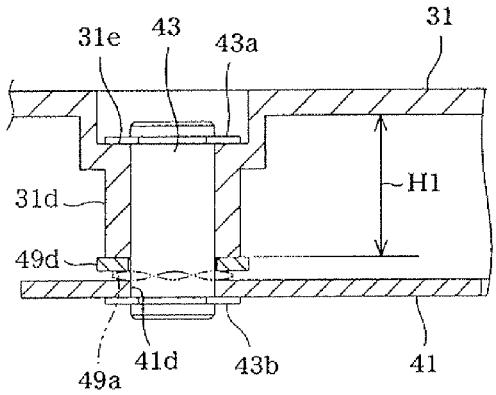
FIGS. 13A and 13B are enlarged sections showing the left and right limiting shafts respectively.

The second spool bracket 31 also has a generally oval upper surface 31*a* and a peripheral wall 31*b* extending along a peripheral edge of the upper surface 31*a*. The upper surface 31*a* and the peripheral wall 31*b* are formed integrally with the second spool bracket 31. The upper surface 31*a* has two pin holes 31*f* spaced away from each other, for example, and spool pins 33 are inserted into the pin holes 31*f* respectively. Two thread spools 21*a* and 21*b* are placed on the upper surface 31*a* substantially in a straight arrangement so as to be horizontally lined, for example. The upper surface 31*a* has one or a rear end formed with a pair of connecting holes 31*c* for connecting to the connecting part 32. Each connecting part 31*c* is formed into a bottomed cylindrical shape so as to protrude downward from the upper surface 31*a* as shown in FIG. 11. The upper surface 31*a* has the other or front end formed with a limiting shaft hole 31*d* for connecting to a holding mechanism 40 which will be described later, as shown in FIG. 8. The limiting shaft hole 31*d* has a stepped portion 31*e* at the upper surface 30*a* side and is formed so as to protrude downward from the upper surface 30*a*, as shown in FIG. 13A.

The first and second spool brackets 30 and 31 are formed so that the escape portions 30*i* and the like are bilaterally symmetrical in order that the divided spool brackets 22 and 23 may be composed of the respective components having the same structure. The pin hole 30*f* of each first spool bracket 30 is formed into a cylindrical shape protruding downward from the upper surface of each spool bracket 30, and the lower end of each spool pin 33 is inserted through the pin hole 30*f*, as shown in FIG. 10. The lower end of each spool pin 33 is formed with an engagement piece 33*a* which is engaged with the underside of the pin hole 30*f* and a flange 33*b* which is engaged with the upper surface 30*a* of each spool bracket 30 and a flange 33*b* engaged with the upper surface 30*a* of each spool bracket 30 with the engagement piece 33*a* being in an engaged state. Each spool pin 33 is held in a vertical state by the engagement piece 33*a* and the flange 33*b* so as to be prevented from backlash in the pin hole 30. The second spool bracket 31 also has a pin hole 31*f* constructed in the same manner as the pin hole 30*f*, and the spool pin 33 is held in the vertical state by the engagement piece 33*a* and the flange 33*b* so as to be prevented from backlash in the pin hole 31*f*.

The two pairs of the first and second spool brackets 30 and 31 are provided with metal connecting plates 35 located in the back of the rears respectively as shown in FIG. 8. Each connecting plate 35 is generally formed into the shape of an isosceles triangle as viewed in a planar view and has a small hole 35*a* (see FIG. 11) formed in an apex side end thereof and a pair of female screws 35*b* formed in both base angle side ends by a burring process respectively. A columnar connecting shaft 36 is inserted through a connecting hole 30*d* of the first spool bracket 30 and includes a rivet 36*a* which is provided on a lower end thereof and inserted into the hole 35*a*. More specifically, the rivet 36*a* has a distal end which is swaged so that the connecting shaft 36 is locked to the periphery of the hole 35*a*. Furthermore, the connecting shaft 36 has an upper part into which a screw 36*b* is threadingly inserted. The connecting shaft 36 is prevented from dropping by providing a spring washer 36*c* and a washer 36*d* between the head of the screw 36*b* and the stepped portion 30*h* of the connecting hole 30*d*. A wave washer 39*a* and a washer 39*b* are provided between a lower end of the connecting hole 30*d* and the connecting plate 35 in the first spool bracket 30. Oscillation of the multi-needle sewing machine M is absorbed by the wave washer 39*a* and washer 39*b* in the connecting plate 35, and a swing of the connecting plate 35 relative to the first spool bracket 30 is rendered smooth.

A pair of screws 37 extending through a pair of connecting holes 31*c* of the second spool bracket 31 are threadingly engaged with female screws 35*b* of the connecting plate 35. Spring washers 37*a* and washers 37*b* are provided between heads of the screws 37 and the bottoms of the bottomed cylindrical connecting holes 31*c* respectively. The above-described connecting plate 35, connecting shaft 36, screws 37, washers 37*a*, 39*a*, washers 37*b* and 39*b* constitute a connecting portion 32 which connects the rear end of the second thread spool bracket 31 to the rear end of the first thread spool bracket 30.

Figure 13B:
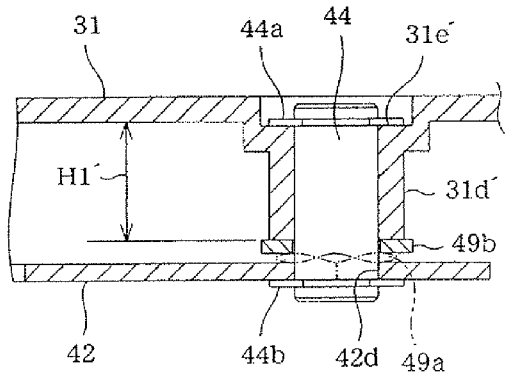

The right divided spool bracket 23 is disposed so as to be symmetric with the above-described left divided spool bracket 22 with the straight line L1 extending through the center of the sewing machine boy 7 in the front-back direction, as shown in FIG. 8. More specifically, the right divided spool bracket 23 includes a first spool bracket 30, second spool bracket 31 and connecting portion 32 all of which have the same structures as and are bilaterally symmetrical with those in the left divided spool bracket 22, respectively. For example, five thread spools 21*f* to 21*j* are mounted on the left divided spool bracket 23. As shown in FIGS. 13A and 13B in contrast with each other, the right divided spool bracket 23 has a protrusion dimension H1' which terminates at the lower end of a limiting shaft hole 31*d'* and is set so as to be slightly smaller than a protrusion dimension H1 of the limiting shaft hole 31*d*. Two same limiting shafts 43 and 44 are inserted through the limiting shaft holes 31*d* and 31*d'* respectively as will be described in detail later.

A pair of female screws 20*c* and 20*d* (see FIGS. 9A and 10) are formed by a burring process so as to be located at respective right and left sides in a middle portion of the support base 20 in the front-back direction. The pivot shafts 24 and 25 are to be mounted on the female screws 20*a* and 20*d* respectively. The pivot shafts 24 and 25 have lower ends formed integrally with small screw portions 24*a* and 25*a* respectively. The screw portions 24*a* and 25*a* are configured as pivoting units for the divided spool bases 22 and 23 respectively. More specifically, the pivot shafts 24 and 25 are inserted, from above, through pivot shaft holes 30*c* of the first spool brackets 30 of the divided spool brackets 22 and 23 so that the screw portions 24*a* and 25*a* are threadingly engaged with the female screws 20*c* and 20*d* of the support base 20, respectively. As a result, the pivot shafts 24 and 25 support the divided spool brackets 22 and 23 so that the spool brackets 22 and 23 are swingable relative to the support base 20, respectively. Furthermore, wave washers 38*a* and washers 38*b* are provided between heads of the pivot shafts 24 and 25 and stepped portions 30*g* of the pivot shaft holes 30*c* respectively. Oscillation of the multi-needle sewing machine M is absorbed by the wave washers 38*a* and washer 38*b* in the pivot shafts 24 and 25, and a swinging movement of the divided spool brackets 22 and 23 relative to the support base 20 is rendered smooth.

Figure 9B:
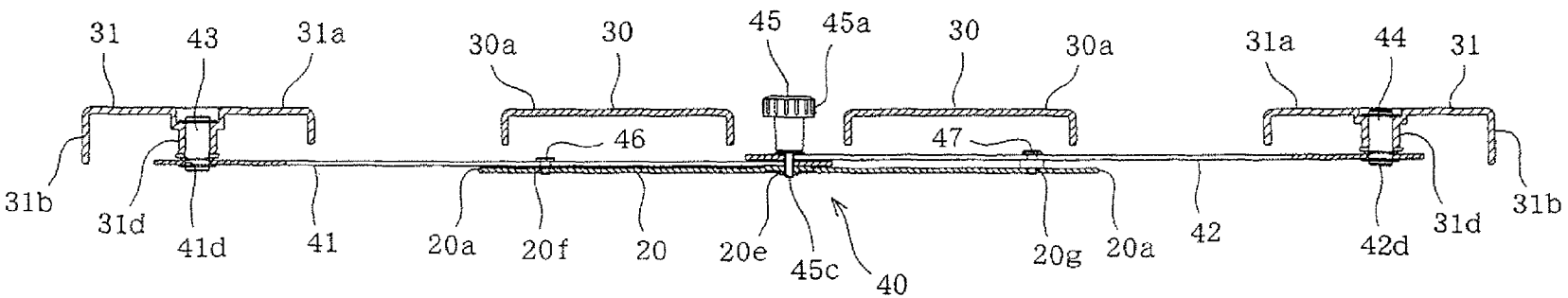
FIG. 9B is a sectional view taken along line IXb-IXb in FIG. 8.
Figure 17A:
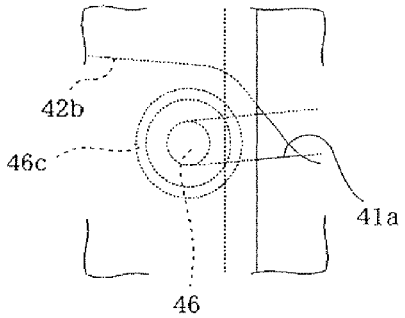
FIGS. 17A and 17B are enlarged plan views of left and right guide pins and peripheries respectively.
Figure 17B:
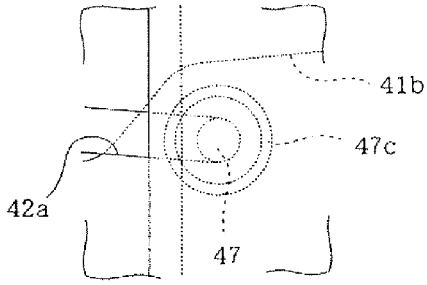

The support base 20 is provided with the holding mechanism 40 which holds the divided spool brackets 22 and 23 at the aforementioned use or storage position. The holding mechanism 40 includes a pair of limiting plates 41 and 42, two limiting shafts 43 and 44 connecting the limiting plates 41 and 42 and the second spool brackets 31, and a fastening member 45 for locking the limiting plates 41 and 42 to the support base 20 respectively as shown in FIGS. 8 and 9A and 9B. The limiting plates 41 and 42 are mounted on the support base 20 so as to be movable in respective predetermined directions. The right and left limiting plates 42 and 41 have the same structure and are each formed into the shape of an elongated plate as shown in FIG. 8. The limiting plates 41 and 42 have widthwise central portions formed with lengthwise-extending slits 41*a* and 42*a* respectively. The limiting plates 41 and 42 have lengthwise ends with escape portions 41*b* and 42*b* formed by notching front portions respectively as shown in FIGS. 17A and 17B as well as FIG. 14A.

Figure 14A:
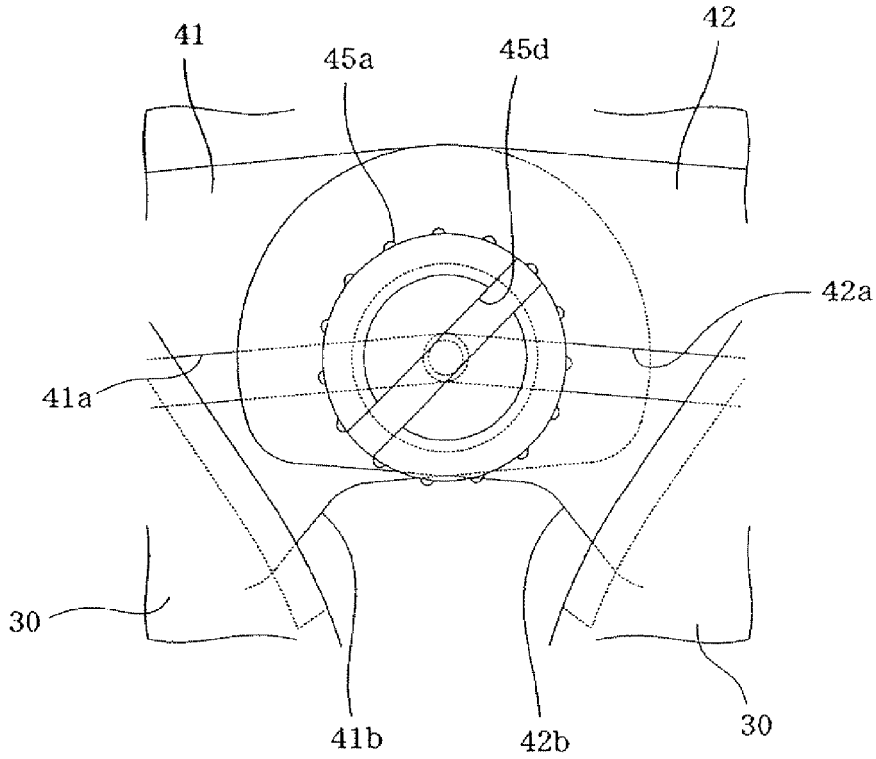
FIGS. 14A and 14B are a plan view and a longitudinal front section of a fastening member and periphery respectively.
Figure 14B:
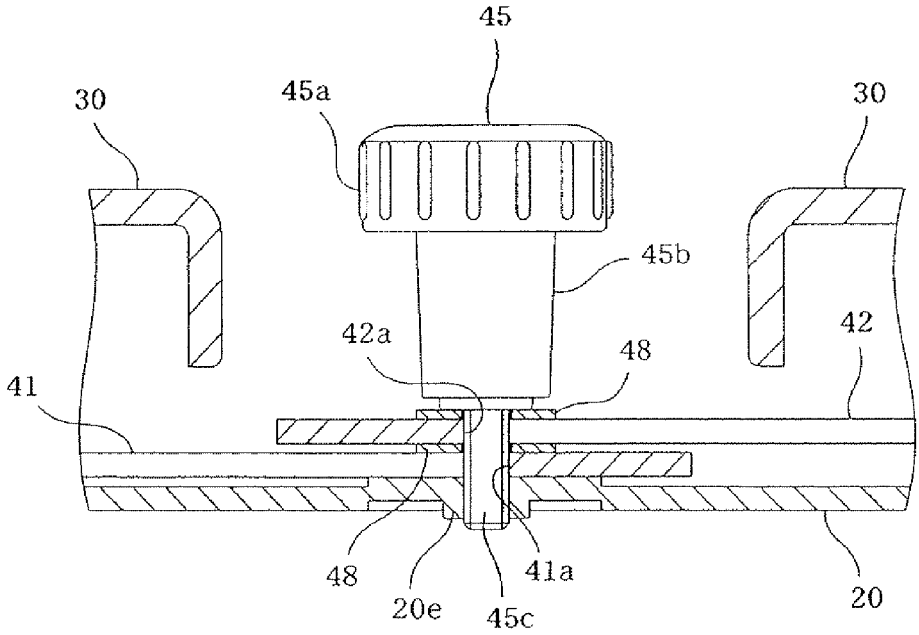

The fastening member 45 serving as the locking unit releasably locks the limiting plates 41 and 42 moved relative to the support base 20. The fastening member 45 has a vertically middle cylindrical portion 45*b*, a knob 45*a* formed on an upper end of the cylindrical portion 45*b* and a screw portion 45*c* formed on a lower end of the cylindrical portion 45*b* as shown in FIGS. 14A and 14B. The knob 45*a* has a tool groove 45*d* formed in an upper surface thereof. Accordingly, the knob 45*a* can be turned with a tool as well as by fingers.

Figure 16:
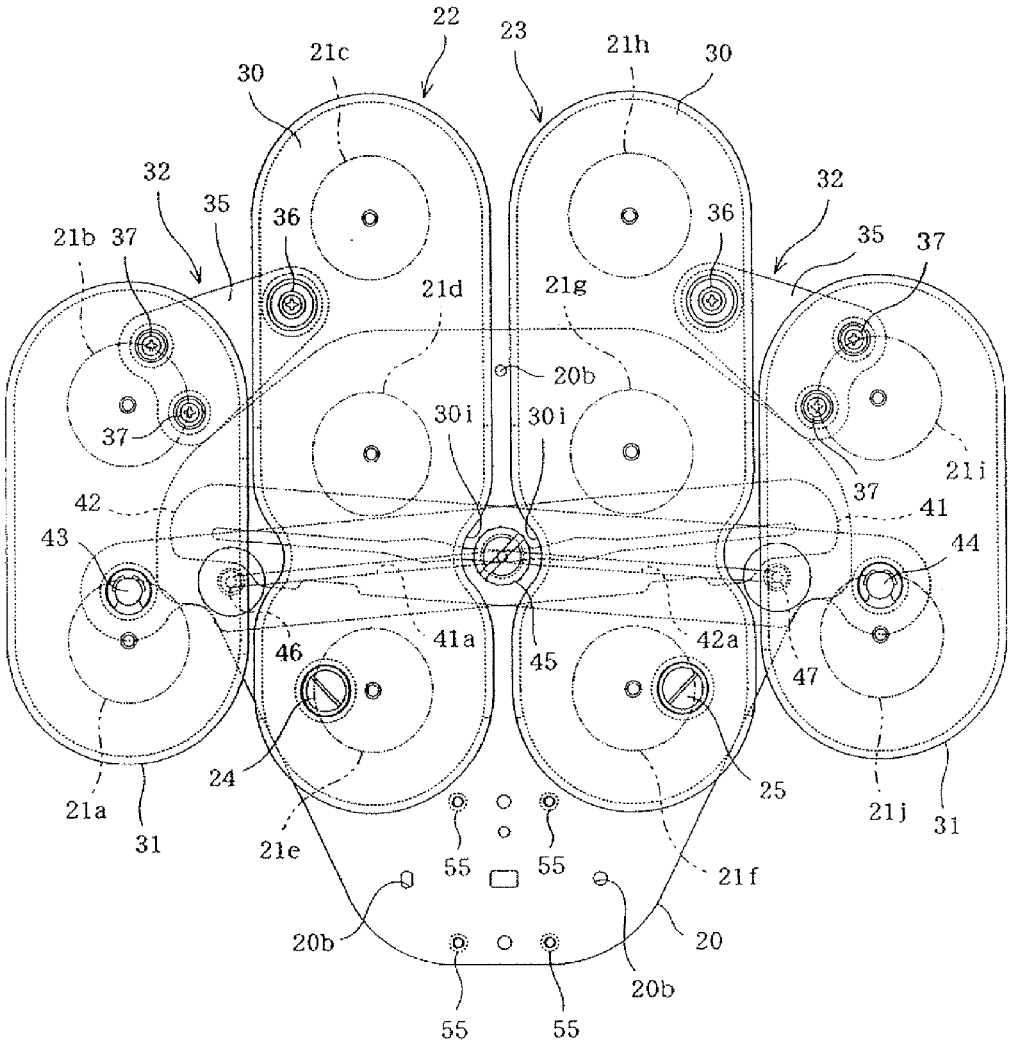
FIG. 16 is a view similar to FIG. 8, showing the multi-needle embroidery sewing machine in the case where the divided spool holder base is located at the storage position.

The support base 20 has a female thread 20*c* formed substantially in a central portion thereof. The screw portion 45*c* of the fastening member 45 is inserted through the slits 41*a* and 42*a* of the limiting plates 41 and 42 vertically placed one upon the other, respectively and then threadingly engaged with the female thread 20*e* of the support base 20. When the knob 45*a* is turned in a predetermined direction, the fastening member 45 presses the limiting plates 41 and 42 between the lower end of the cylindrical portion 45*b* and the support base 20 thereby to fix the limiting plates 41 and 42. On the other hand, the fastening member 45 releases the limiting plates 41 and 42 from the fastened state when the knob 45*a* is turned in the direction opposed to the predetermined direction. Washers 48 are provided between the cylindrical portion 45*b* and the limiting plate 41 and between the limiting plates 41 and 42 in order that the limiting plates 41 and 42 may smoothly be moved, respectively. Furthermore, the fastening member 45 is located between the escape portions 30*i* and 39*j* of both first spool brackets 30 when the divided spool brackets 22 and 23 occupy the storage position, as shown in FIG. 16.

Figure 12A:
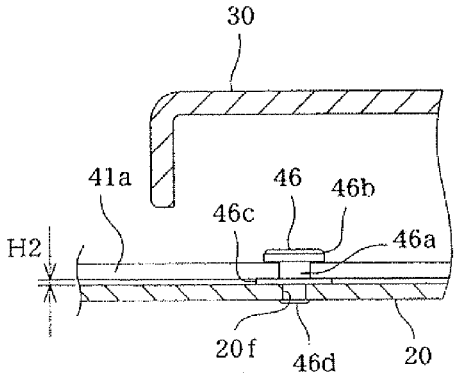
FIGS. 12A and 12B are enlarged sections showing right and left guide pins and peripheries respectively.
Figure 12B:
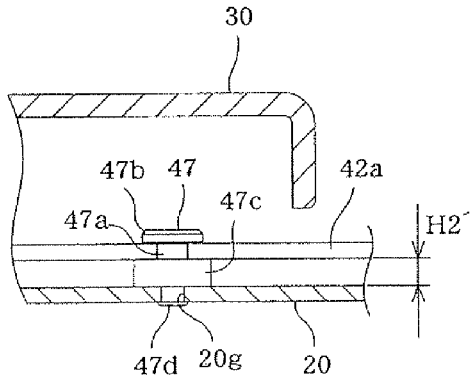

The support base 20 has two pin holes 20*f* and 20*g* formed near right and left extending portions 20*a* respectively as shown in FIGS. 9B, 12A and 12B. The pin holes 20*f* and 20*g* are located slightly ahead of the fastening member 45. Two guide pins 46 and 47 are provided in the pin holes 20*f* and 20*g* respectively. The left guide pin 46 has a guide portion 46*a* which has a small diameter and is inserted through the slit 41*a* of the limiting plate 41 so that the limiting plate 41 is guided by the left guide pin 46. More specifically, the left guide pin 46 has the guide portion 46*a*, a retaining portion 46*b* which has a large diameter and is formed on an upper end of the guide portion 46*a*, a spacer portion 46*c* formed on a lower end of the guide portion 46*a*, and a rivet portion 46*d* formed on the underside of the spacer portion 46*c*, all of which are integrally formed with the left guide pin 46. The guide pin 46 is locked by the peripheral edge of the pin hole 20*f* by inserting the rivet portion 46*d* through the left pin hole 20*f* and swaging the distal end of the rivet portion 46*d*.

The right guide pin 47 also has a guide portion 47*a* which is to be inserted through the slit 42*a* of the limiting plate 42, a retaining portion 47*b*, a spacer portion 47*c* and a rivet portion 47*d*, all of which are formed integrally with the right guide pin 47, in the same manner as the above-described left guide pin 46. The guide pin 47 is locked by swaging the distal end of the rivet portion 47*d* in the right pin hole 20*g* of the support base 20. The spacer portion 47*c* of the right guide pin 47 has a larger axial dimension H2' than the left spacer portion 46*c* by a thickness of the limiting plate 41 as understood from comparison of FIGS. 12A and 12B.

The slit 41*a* of the left limiting plate 41 has a wide through-insertion portion 41*c* located at a lengthwise middle portion thereof. The retaining portion 46*b* and the guide portion 46*a* of the guide pin 46 are inserted through the slit 41*a* from the through-insertion portion 41*c*. The limiting plate 41 is guided by the guide portion 46*a* and the screw portion 45*c* of the clamping member 45 both inserted through the slit 41*a*, whereby the limiting plate 41 is movable substantially linearly in the direction of arrow D1 along the slit 41*a*. On the other hand, the slit 42*a* of the right limiting plate 42 also has a wide through-insertion portion 42*c* located at a lengthwise middle portion thereof. The retaining portion 47*b* and the guide portion 47*a* of the guide pin 47 are inserted through the slit 42*a* from the through-insertion portion 42*c*. The limiting plate 42 is guided by the guide portion 47*a* and the screw portion 45*c* of the clamping member 45 both inserted through the slit 42*a*, whereby the limiting plate 42 is movable substantially linearly in the direction of arrow D2 along the slit 42*a*. In this case, the left limiting plate 41 is guided above the support base 20 by the spacer portion 46*c* of the guide pin 46, whereas the right limiting plate 42 is guided above the limiting plate 41 by the spacer portion 47*c* of the guide pin 47. As a result, since the limiting plates 41 and 42 are placed vertically one upon the other, the limiting plates 41 and 42 can be prevented from interfering with each other when moved.

The limiting shafts 43 and 44 connect the second spool brackets 31 of the divided spool brackets 22 and 23 to the limiting plates 41 and 42 so that the second spool brackets 31 are swingable, respectively. In more detail, the left limiting plate 41 has a left end formed with a limiting shaft hole 41*d* for the purpose of mounting the limiting shaft 43 as shown in FIGS. 9B and 13A. The limiting shaft 43 is inserted through the limiting shaft hole 41*d* and the limiting shaft hole 31*d* of the left second spool bracket 31. The limiting shaft 43 is retained by a retaining ring 43*a* locked by the stepped portion 31*e* of the limiting hole 31*d* and a retaining ring 43*b* locked by the underside of the limiting plate 41. The left second spool bracket 31 is connected to the limiting plate 41 by the limiting shaft 43 so that the front end of the left second spool bracket 31 is swingable relative to the limiting plate 41.

The right limiting plate 42 has a right end formed with a limiting shaft hole 42*d* for the purpose of mounting the limiting shaft 44 as shown in FIGS. 9B and 13B. The limiting shaft 44 is inserted through the limiting shaft hole 42*d* and the limiting shaft hole 31*d*' of the left second spool bracket 31. The limiting shaft 44 is retained by a retaining ring 44*a* locked by the stepped portion 31*e*' of the limiting hole 31*d*' and a retaining ring 44*b* locked by the underside of the limiting plate 42. The right second spool bracket 31 is connected to the limiting plate 42 by the limiting shaft 44 so that the front end of the right second spool bracket 31 is swingable relative to the limiting plate 42.

Wave washers 49*a* and washers 49*b* are provided between the lower ends of the limiting shaft holes 31*d* and 31*d*' and the limiting plates 41 and 42 respectively. Oscillation of the multi-needle sewing machine M is absorbed by the wave washers 49*a* and washer 49*b* in the limiting plates 41 and 42, and a swinging movement of the second spool brackets 31 relative to the respective limiting plates 41 and 42 is rendered smooth.

The first and second spool brackets 30 and 31 are designed so that the upper surfaces 30*a* of the first spool brackets 30 are located at the same level as the upper surfaces 31*a* of the second spool brackets 31, as shown in FIG. 9B. The first and second spool brackets 30 and 31 are swung in the same horizontal plane. During the swinging movement, the screw portion 45*c* of the fastening member 45 abuts against one ends of inner walls of the slits 41*a* and 42*a* of the limiting plates 41 and 42 as shown in FIG. 14B. On the other hand, the guide pins 46 and 47 abut against the other ends of the inner walls of the slits 41*a* and 42*a* respectively as shown in FIGS. 17A and 17B. As a result, the ranges of swinging movement of the spool brackets 30 and 31 are limited such that the divided spool brackets 22 and 23 are switched between the storage and use positions.

Figure 7:
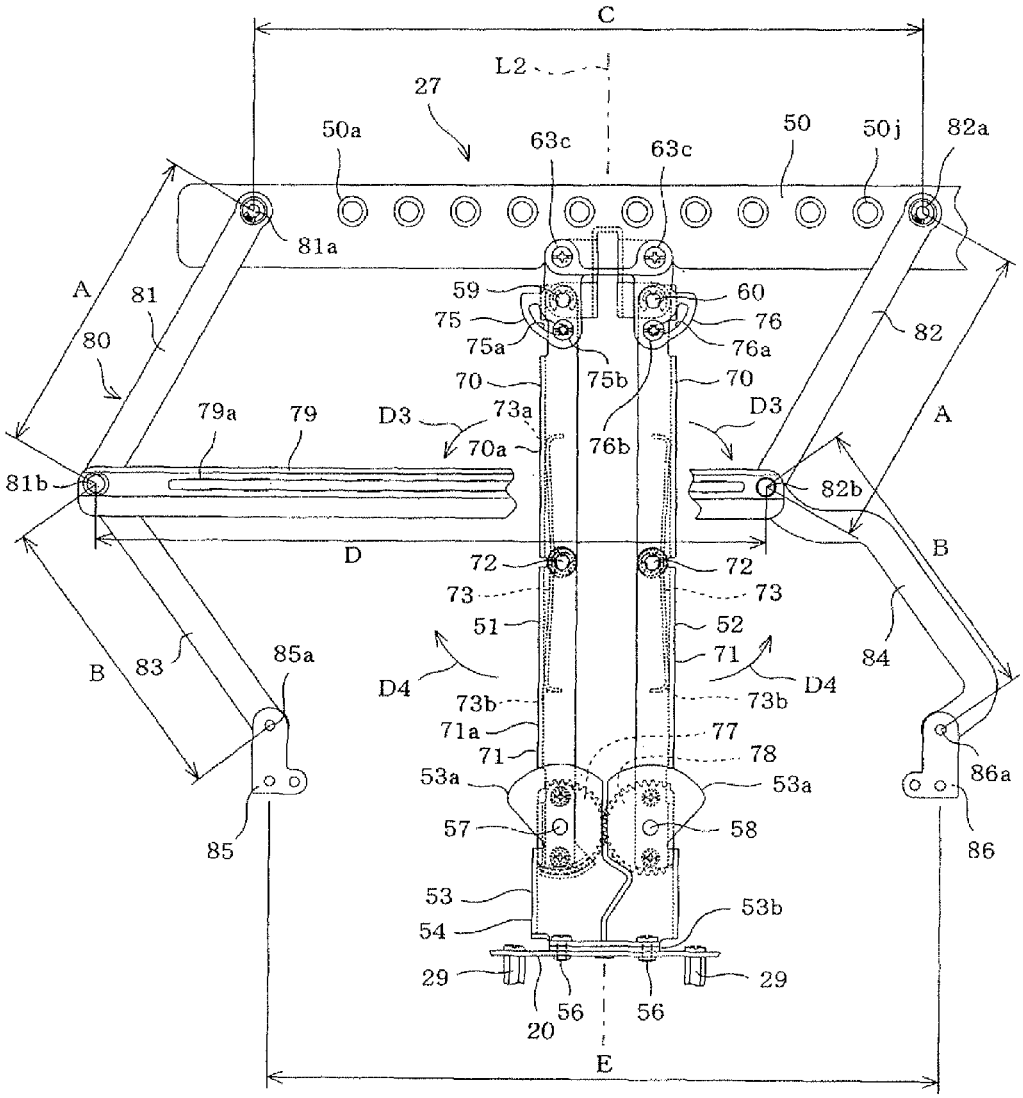
FIG. 7 is a front view of a thread guide mechanism and an intermediate thread guide link mechanism.

A thread guide mechanism 27 will now be described. The thread guide mechanism 27 guides threads drawn from the thread spools 21*a* to 21*j* placed on the divided spool brackets 22 and 23, that is, needle threads T1 to T10. The thread guide mechanism 27 comprises a thread guide member 50 extending substantially horizontally, a pair of divided support pillars 51 and 52 supporting the thread guide member 50 on the support base 20, and a base member 53 for mounting the divided support pillars 51 and 52 on the support base 20, as shown in FIGS. 2 and 7. The thread guide member 50 has, for example, ten thread guide portions 50*a* to 50*j* which are lined substantially in the horizontal direction.

The base member 53 is formed into a generally rectangular cylindrical shape and includes an upper portion formed with a pair of sectorial covers 53*a*. The base member 53 has a lower end formed with a flange-like mounting portion 53*b*. Four screws 56 vertically extending through the mounting portion 53*b* are threadingly engaged with four female threads 55 in the front of the support base 20 respectively as shown in FIG. 8. As a result, the base member 53 is fixed so as to be located on the aforementioned straight line L1. Divided support pillars 51 and 52 are disposed on the base member 53 so as to support the thread guide member 50 via a bridging member 61 as shown in FIG. 2. The bridging member 61 extends rearward from upper ends of the divided support pillars 51 and 52. A thread hooking member 62 is fixed to the rear of the bridging member 61 by a screw 63*a*. The thread hooking member 62 comprises a plurality of plates joined to each other by screws 63*b*. The thread hooking member 62 has thread holes 62*a* to 62*j* located substantially right above the spool pins 33 in the case where the divided spool brackets 22 and 23 are located at the use positions, respectively. Furthermore, auxiliary thread holes 62*b*' to 62*d*' and 62*g*' to 62*i*' are formed in the front of the thread hooking member 62. The needle threads T1 to T10 drawn from the thread spools 21*a* to 21*j* are guided by the thread holes 62*a* to 62*j* and the auxiliary thread holes 62*b*' to 62*d*' and 62*g*' to 62*i*' to the thread guide member 50 side so as not to be entangled, respectively.

Figure 6:
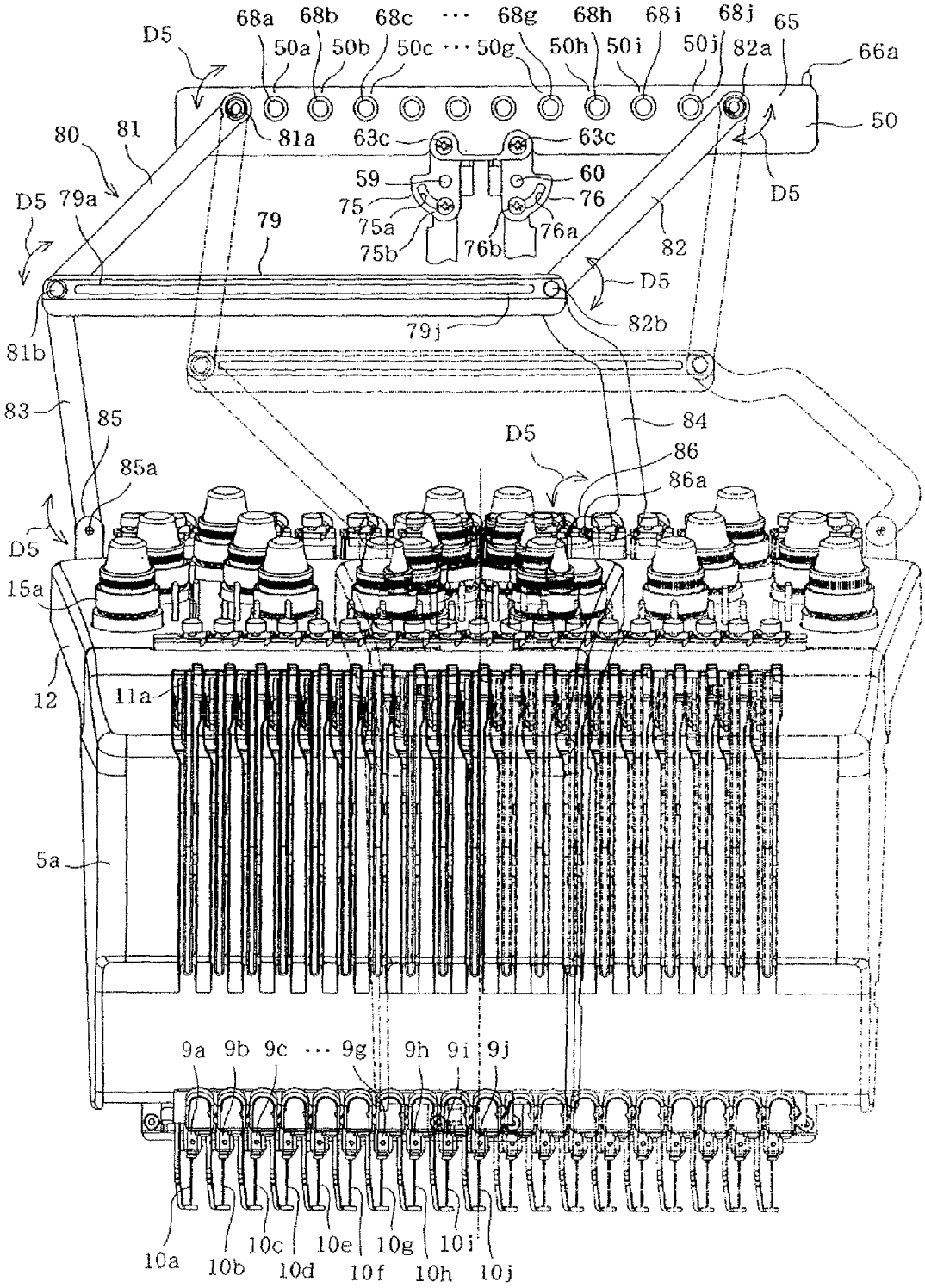
FIG. 6 is a front view of a part from a thread guide member to a needle.

The thread guide member 50 extending in the right-left direction is fixed to a front end of the bridging member 61 by a pair of screws 63*c* (see FIG. 7) substantially in the lengthwise central part thereof. The thread guide member 50 has three elongate plate members 65, 66 and 67 (see FIGS. 3, 5 and 6) laid one upon another back and forth although the arrangement of the plate members are not shown in detail. Predetermined spaces are defined between the plate members 65 and 66 and the plate members 66 and 67 respectively so that the threads are passable through the spaces in bent states. The intermediate plate member 66 has a right end with an upwardly protruding operation convexity 66*a* formed integrally therewith as shown in FIG. 6. The intermediate plate member 66 is movable in the right-left direction relative to both outer plate members 65 and 67.

The thread guide portions 50*a* to 50*j* include ten outer thread insertion holes 68*a* to 68*j* formed in the front plate member 65 as shown in FIG. 6, ten outer thread insertion holes 69*a* to 69*j* formed in the rear plate member 67 as shown in FIG. 3 and ten intermediate thread insertion holes (not shown) formed in the intermediate plate member 66. The outer thread insertion holes 68*a*-68*j* and 69*a*-69*j* are formed in the front and rear plate members 65 and 67 substantially at regular intervals and at opposite positions in a front view respectively. The intermediate thread insertion holes are also formed at the same intervals as the outer thread insertion holes 68*a*-68*j* and 69*a*-69*j*. When moved in the right-left direction by the operation convexity 66, the intermediate thread insertion holes are switchable between a use position where the intermediate thread insertion holes are displaced in the right-left direction relative to the outer thread insertion holes 68*a*-68*j* and 69*a*-69*j* and a threading position where the positions of the intermediate thread insertion holes substantially correspond with the positions of the outer thread insertion holes 68*a*-68*j* and 69*a*-69*j* respectively. When the intermediate plate member 66 is located at the threading position, threads can be inserted through the outer thread insertion holes 68*a*-68*j* and 69*a*-69*j* and the intermediate thread insertion holes respectively. The intermediate plate member 66 is moved to the use position after the needle threads T1 to T10 have been inserted through the respective thread insertion holes. As a result, the intermediate thread insertion holes are displaced in the right-left direction relative to the outer thread insertion holes 68*a*-68*j* and 69*a*-69*j* such that the needle threads T1 to T10 are bent.

Each divided support pillar 51, 52 is divided into two parts, for example, as shown in FIG. 7. The divided support pillars 51 and 52 are disposed so as to be symmetrical about the straight line L2, as a symmetrical axis, which passes the center of the sewing machine body 7, extending vertically. More specifically, the right and left divided support pillars 52 and 51 have the same structure and disposed on the base member 53 so as to be bilaterally symmetrical. Accordingly, the left divided support pillar 51 will hereinafter be described.

Upper and lower support pillars 70 and 71 are made of a metal plate into respective elongate shapes and have substantially the same length. Each support pillar 70, 71 is formed so as to have a generally C-shaped section and has an open inner side or line L2 side.

The upper and lower support pillars 70 and 71 are connected to each other by a connecting pin 72 which extends through holes (not shown) formed in lower and upper ends of the respective upper and lower support pillars 70 and 71 laid one upon the other, whereupon the upper and lower support pillars 70 and 71 are swingable about the connecting pin 72. A torsion coil spring 73 serving as an elastic member is provided around the connecting pin 72. The torsion coil spring 73 has two ends, and one end 73*a* thereof is locked by a side wall 70*a* of the upper support pillar 70, while the other end 73*b* thereof is locked by a side wall 71*a* of the lower support pillar 71. Accordingly, the torsion coil spring 73 urges the upper support pillar 70 in the direction of arrow D3 and the lower support pillar 71 in the direction of arrow D4 in FIG. 7. The torsion coil spring 73 has a spring force that is set so that the divided support pillar 51 is prevented from being suddenly bent into an L-shape at a part thereof corresponding to the connecting pin 72. The position of the divided support pillar 51 bent at the portion of the connecting pin 72 corresponds to a second position as will be described later.

The right divided support pillar 52 has the same structure as the above-described divided support pillar 51 and is bilaterally symmetrical with the straight line L2 serving as a symmetrical axis. The divided support pillar 52 is also provided with an upper support pillar 70, a lower support pillar 71, a connecting pin 72 and a torsion coil spring 73. The divided support pillars 51 and 52 are mounted on upper pivot pins 59 and 60 extending through holes (not shown) formed in upper ends thereof respectively. The upper pivot pins 59 and 60 are further mounted on the thread guide member 50 so that the divided support pillars 51 and 52 are swingable about the upper pivot pins 59 and 60, respectively. Furthermore, the divided support pillars 51 and 52 are mounted on lower pivot pins 57 and 58 extending through holes (not shown) formed in lower ends thereof. The lower pivot pins 57 and 58 are further mounted on the base member 53 so that the divided support pillars 51 and 52 are swingable about the lower pivot pins 57 and 58, respectively. As a result, the divided support pillars 51 and 52 are each switched between a first position where the upper and lower support pillars 70 and 71 are arranged substantially vertically in series, as shown in FIG. 7 and a second position (not shown) where the upper and lower support pillars 70 and 71 are bent at connecting pins 72. In this case, when assuming the first position, the divided support pillars 51 and 52 locate the thread guide member 50 above a position in use. When assuming the second position, the divided support pillars 51 and 52 locate the thread guide member 50 at a storage position in non-use.

In more detail, the upper support pillars 70 have upper ends on which locking plates 75 and 76 having a pair of sectorial portions respectively, as shown in FIG. 6. The locking plates 75 and 76 are each made of a metal plate and formed so as to be bilaterally symmetrical. The left locking plate 75 includes a lower half formed with an arc guide groove 75*a* extending along an outer edge of the sectorial portion thereof. The left locking plate 75 further includes an upper pivot pin 59 located substantially at the center of the arc. The right locking plate 76 also includes an arc guide groove 76*a* and an upper pivot pin 60 located substantially at the center of the arc. The locking plates 75 and 76 are disposed along the rear side of the thread guide member 50 and the front side of the divided support pillars 51 and 52 respectively. In the above-described state, the locking plates 75 and 76 are fixed to a front end of the bridging member 61 by a pair of screws 63*c*.

The bridging member 61 has two pivot pin attachment portions 61*a* formed integrally on a lower front thereof as shown in FIG. 2. The upper pivot pins 59 and 60 are provided so as to extend through the pivot pin attachment portions 61*a*, the upper ends of the divided support pillars 51 and 52 and the locking plates 75 and 76 respectively. The paired upper support pillars 70 have upper ends on which female threads (not shown) are formed by a burring process so as to face the guide grooves 75*a* and 76*a* of the locking plates 75 and 76 respectively. Locking screws 75*b* and 76*b* inserted through the guide grooves 75*a* and 76*a* are threadingly engaged with the female threads so that the upper support pillars 70 are fastened to be fixed.

More specifically, the upper support pillars 70 each in the swinging movement are locked as the result of fixation of the locking screws 75*b* of the locking plates 75 and 76 respectively. Consequently, the divided support pins 51 and 52 can be retained in respective desirable positions. On the other hand, when the locking screws 75*b* and 76*b* are loosened, the upper support pillars 70 are released from the locked state, whereupon the positions of the divided support pillars 51 and 52 can be changed. The locking screws 75*b* and 76*b* abut against the both ends of inner walls of the guide grooves 75*a* and 76*a* when the upper support pillars 70 are swung. Thus, ranges of swinging movement of the upper support pillars 70 are limited, so that the positions of the divided support pillars 51 and 52 are switched between the first and second positions.

A pair of lower support pillars 71 have lower ends to which sector gears 77 and 78 are fixed, respectively, as shown in FIG. 7. The left lower support pin 57 is provided so as to extend through the base member 53 in the front-rear direction. The left lower support pin 57 further extends through the lower end of the left lower support pillar 71 and the sector gear 77. The right lower support pin 58 is also provided so as to extend through the base member 53 in the front-rear direction. The right lower support pillar 58 further extends through the lower end of the right lower support pillar 71 and the sector gear 78. The sector gears 77 and 78 are formed so as to have respective pitch diameters equal to each other. The right and left lower support pillars 71 are symmetrically swung about the lower pivot pins 57 and 58 by threading engagement of the sector gears 77.

An intermediate thread guide member 79 having intermediate thread guide portions 79*a* to 79*j* is provided between the thread guide portions 50*a* to 50*j* and the thread entrances 13*a* to 13*j* as shown in FIGS. 5 and 6. The intermediate guide portions 79*a* to 79*j* are formed into round holes extending through the intermediate thread guide member 79 and lined substantially in a horizontal direction at the same pitch as the thread guide members 50*a* to 50*j* (or thread entrances 13*a* to 13*j*). When the thread entrances 13*a* to 13*j* are moved together with the needle bar case 5, the intermediate thread guide member 79 is moved by an intermediate thread guide link mechanism 80 according to movement of the needle bar case 50 as shown in FIG. 6. The intermediate thread guide link mechanism 80 includes a pair of first link members 81 and 82 connecting the thread guide member 50 and the intermediate thread guide member 79 and a pair of second link members 83 and 84 connecting the intermediate thread guide member 79 and a rear end of the thread tension bracket 12.

The left first link mechanism 81 has an upper end which is mounted on a pivot pin 81*a* further mounted on a left end of the thread guide member 50 so that the upper end of the first link mechanism 81 is rotatably movable in the direction of arrow D5. The first link mechanism 81 has a lower end which is mounted on a pivot pin 81*b* further mounted on a left end of the intermediate thread guide member 79 so that the lower end of the link mechanism 81 is rotatably movable in the direction of arrow D5. The right first link mechanism 82 has an upper end which is mounted on a pivot pin 82*a* further mounted on a right end of the thread guide member 50 so that the upper end of the link mechanism 82 is rotatably movable in the direction of arrow D5. The right first link mechanism 82 has a lower end which is mounted on a pivot pin 82*b* further mounted on a right end of the intermediate thread guide member 79 so that the lower end of the first link mechanism 82 is rotatably movable. The first link members 81 and 82 have the same link length A as shown in FIG. 7. In other words, a distance between the linkage fulcrums 81*a* and 81*b* is equal to a distance between the linkage fulcrums 82*a* and 82*b*. A support piece 85 is provided on the left end of the needle bar case 5 so as to be located near the thread entrance 13*a*. A support piece 86 is provided on the right end of the needle bar case 5 so as to be located near the thread entrance 13*j*.

On the other hand, the left second link member 83 has a lower end which is mounted on a support shaft 85*a* further mounted on the support piece 85 so that the lower end of the second link member 83 is rotatably movable in the direction of arrow D5. The second link member 83 has an upper end which is mounted on the pin 81*b* further mounted on the left end of the intermediate thread guide member 79 so that the upper end of the link mechanism 83 is rotatably movable in the direction of arrow D5. The right second link member 84 has a lower end which is mounted on a support shaft 86*a* further mounted on the support piece 86 so that the lower end of the second link member 84 is rotatably movable in the direction of arrow D5. The second link member 84 has an upper end which is mounted on the pin 82*b* further mounted on the intermediate thread guide member 79 so that the upper end of the link mechanism 84 is rotatably movable in the direction of arrow D5. The second link mechanism 84 is formed substantially into a bow shape in a front view, whereas the other link members 81 to 83 are linear. The second link members 83 and 84 have the same link length B. In other words, a distance between the linkage fulcrums 85*a* and 81*b* is equal to a distance between the linkage fulcrums 86*a* and 82*b*. A distance C between the pins 81*a* and 82*a* is set so as to be equal to a distance D between the pins 81*b* and 82*b* and to a distance E between the support shafts 85*a* and 86*a* as shown in FIG. 7. As a result, the link members 81 to 84 and the intermediate thread guide member 79 constitute a parallel link mechanism.

The needle threads T1 to T10 extend upward from thread spools 21*a* to 21*j* of the spool holder 19. The needle threads T1 to T10 are passed sequentially through threading holes 62*a* to 62*j* of the thread guide mechanism 27, the thread guide portions 50*a* to 50*j* and the intermediate thread guide portions 79*a* to 79*j*, introduced into the thread entrances 13*a* to 13*j*, respectively. The needle threads T1-T10 having been introduced into the respective thread entrances 13*a* to 13*j* are further passed through a predetermined thread supply path including the auxiliary thread guides 14*a* to 14*j*, the thread tensioners 15*a* to 15*j* and the thread take-up levers 11*a* to 11*j*, thereafter being inserted through eyes (not shown) of the needles 10*a* to 10*j*, respectively, as shown in FIG. 1. The needle threads T1-T10 are guided so as to extend in parallel in a section from the thread guide portions 50*a*-50*j* through the intermediate thread guide portions 79*a*-79*j* to the thread entrances 13*a*-13*j*. The intermediate thread guide portions 79*a*-79*j* are moved with movement of the needle bar case 5 relative to the thread guide member 50. In this case, the intermediate thread guide portions 79*a*-79*j* are moved by the intermediate thread guide link mechanism 80 in parallel with the direction of alignment of the thread guide portions 50*a*-50*j* and with the direction of alignment of the thread entrances 13*a*-13*j*. Consequently, even when the needle bar case 5 is moved with the thread entrances 13*a*-13*j*, occurrence of thread entanglement can be prevented by the action of the intermediate thread guide link mechanism 80.

Figure 15:
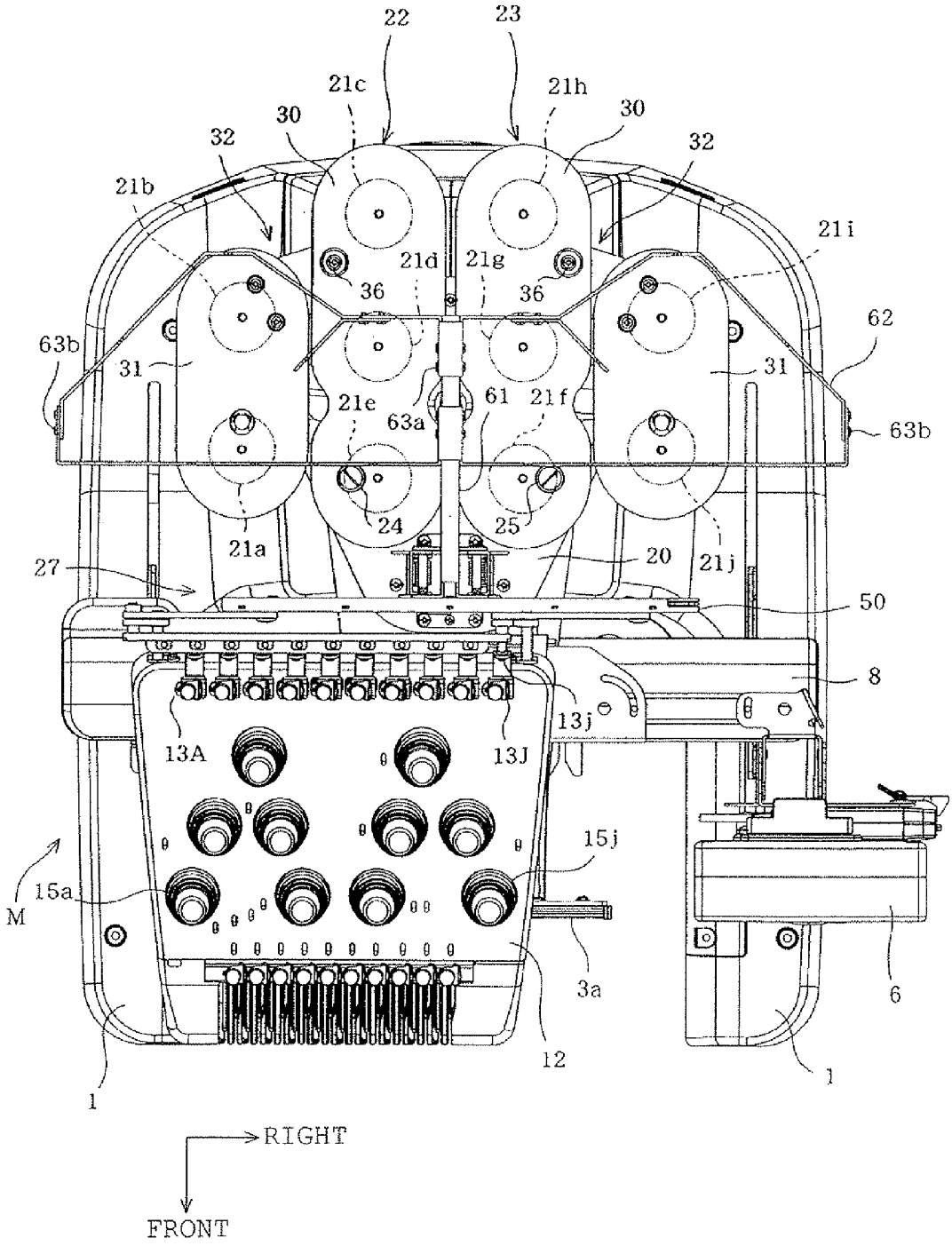
FIG. 15 is a view similar to FIG. 4, showing the multi-needle embroidery sewing machine in the case where the divided spool holder base is located at the storage position.

The multi-needle sewing machine M constructed above will work as follows. The first and second spool brackets 30 and 31 are substantially in parallel with each other in the lengthwise direction and adjacent to each other when the divided spool brackets 22 and 23 are located at the respective storage positions, as shown in FIGS. 15 and 16. In this state, the divided spool brackets 22 and 23 are fastened via the limiting plates 41 and 42 by the fastening member 45 thereby to be fixed. Furthermore, in this state of nonuse, the fastening member 45 is located between the escape portions 30*i* of both first spool brackets 30. The first and second spool brackets 30 and 31 are compactly accommodated without protruding rearward from the multi-needle sewing machine M and in the right-left direction.

When the divided spool brackets 22 and 23 are switched to the use position as shown in FIGS. 4 and 8, the user turns the knob 45*a* of the fastening member 45 in a predetermined direction so that the limiting plates 41 and 42 are released from the fastening state. The user further operates the knob 45*a* so that the second spool brackets 31 are moved outward. As a result, the second spool brackets 30 are swung about the pivot shafts 24 and 25 and the second spool brackets 31 are swung about the connecting shafts 36, respectively. With the swinging movement, the spool brackets 30 and 31 are switched from the storage position where the spool brackets 30 and 31 are adjacent to one another to the use position where the spool brackets 30 and 31 are spread into a nonparallel shape as shown in FIG. 8. In the switching, the front end of the left second spool bracket 31 is moved via the limiting shaft 43 substantially linearly in the direction of arrow D1 in FIG. 8 along the limiting plate 41, and the front end of the right second spool bracket 31 is moved via the limiting shaft 44 substantially linearly in the direction of arrow D2 in FIG. 8 along the limiting plate 42. Accordingly, the first and second spool brackets 30 and 31 can be swung to the location where the spool brackets 30 and 31 are bilaterally symmetric. As a result, the divided spool brackets 22 and 23 are readily switched to the use position where the first and second spool brackets 30 and 31 are arranged into an M-shape in a planar view.

The limiting plates 41 and 42 are fastened to the support base 20 when the user turns the knob 45*a* of the fastening member 45 in the direction opposed to the aforesaid predetermined direction. The divided spool brackets 22 and 23 can reliably be held at the use position via the limiting plates 41 and 42. Furthermore, when the divided spool brackets 22 and 23 are re-switched from the use position to the storage position, the user turns the knob 45*a* of the fastening member 45 in the predetermined direction. As a result, the limiting plates 41 and 42 are released from the fastened state and thereafter, the respective second spool brackets 31 are operated so as to be moved inward.

The spool holder 19 in the embodiment includes the divided spool brackets 22 and 23. The divided spool brackets 22 and 23 are switchable between the storage position where the first and second spool brackets 30 and 31 are adjacent to each other substantially in parallel in the lengthwise direction and the use position where the first and second spool brackets 30 and 31 are spread into the nonparallel shape when the first spool brackets 30 are swung about the respective pivot shafts 24 and 25 and the second spool brackets 31 are swung about the respective connecting shafts 36.

When the spool bracket comprises a plurality of divided spool brackets 22 and 23 as described above, a larger number of thread spools 21*a*-21*j* can be placed separately on the first and second spool brackets 30 and 31. Furthermore, as the result of the division, an increase in the sizes of the first and second spool brackets 30 and 31 in the lengthwise or depthwise dimensions can be suppressed. Accordingly, even when thread spools are placed on the rear or inner part of each spool bracket, these thread spools can be changed more easily. Furthermore, since the first and second spool brackets 30 and 31 are connected by the connecting part so as to be swingable, the first spool bracket 30 can be operated simultaneously with the second spool bracket 31. Accordingly, the first and second spool brackets 30 and 31 need not be held individually when switched between the store and use positions. Consequently, the multi-needle sewing machine M can be rendered more convenient. Moreover, when switched from the use position to the store position, the divided spool brackets 22 and 23 can be stored in a compact state while being adjacent to each other substantially in parallel in the lengthwise direction.

The support base 20 is provided with the holding mechanism 40 which holds the divided spool brackets 22 and 23 at the use or storage position. When the divided spool brackets 22 and 23 are held at the use position by the holding mechanism 40, the spool brackets 30 and 31 can be prevented from being displaced by the oscillation of the multi-needle sewing machine M or the like. Furthermore, since the spool holder 19 can be carried while the divided spool brackets 22 and 23 are held at the storage position by the holding mechanism 40, the multi-needle sewing machine M can be rendered further more convenient.

The holding mechanism 40 includes a pair of limiting plates 41 and 42 which are disposed so as to be movable substantially linearly in the predetermined direction relative to the support base 20 and to which the aforesaid other ends of the second spool brackets 31 opposed to the aforesaid one ends of second spool brackets 31 at the connecting portion 32 side are connected so as to be swingable. The holding mechanism 40 further includes a fastening member 45 which locks the limiting plates 41 and 42 to the support base 20 so as to be disengageable. In this construction, both ends of the divided spool brackets 22 and 23 are supported via the pivot shafts 24 and 25 and the holding mechanism 40 on the support base 20. Accordingly, the first and second spool brackets 30 and 31 can be held in the stable state. Furthermore, the limiting plates 41 and 42 can be held by a simple construction in which the limiting plates 41 and 42 are locked by the fastening member 45. Still furthermore, the divided spool brackets 22 and 23 can easily be switched between the storage and use positions by the substantially linear movement of the limiting plates 41 and 42 in the predetermined direction.

The thread guide mechanism 27 includes the thread guide member 50 having the thread guide portions 50*a*-50*j* and the support pillars or divided support pillars 51 and 52 supporting the thread guide member 50 on the support base 20. The two divided spool brackets 22 and 23 are disposed so as to be bilaterally symmetrical with the support pillar being interposed therebetween. In this construction, the needle threads T1-T10 drawn from the thread spools 21*a*-21*j* are guided by the thread guide member 50 of the thread guide mechanism 27. When the divided spool brackets 22 and 23 are disposed on the support pillars of the thread guide mechanism 27 so as to be bilaterally symmetrical with each other, a larger number of thread spools 21*a*-21*j* can be placed on the spool holder, and the divided spool brackets 22 and 23 can stably be supported on the support base 20.

The two divided spool brackets 22 and 23 are constructed so that the first and second spool brackets 30 and 31 are arranged in the M-shape in a planar view when the divided spool brackets 22 and 23 are located at the use position. Accordingly, the thread spools 21*b*, 21*c*, 21*h* and 21*i* placed on the rear of the spool brackets 30 and 31 with the spool brackets 22 and 23 being located at the storage position can be caused to come closer to the front side or user side, whereupon the thread spools can be replaced more easily.

The above-described spool holder can be applied to every type of sewing machine as well as the above-described multi-needle sewing machine M. Furthermore, the spool holder may be separate from the sewing machine body although the spool holder is incorporated in the sewing machine body in the foregoing embodiment.

In the foregoing embodiment, three thread spools are placed on each first spool bracket 30, whereas two thread spools are placed on each second spool bracket 31. The number of thread spools placed on each spool bracket should not be limited to the above-described one. A plurality of thread spools may be placed on each of the first and second spool brackets so as to be lined in the horizontal direction. A single thread spool may be placed on each second spool bracket. Furthermore, the number of needle bars may be small or larger than 10 and the number of thread guides may be determined according to the number of needle bars. Although the number of divided spool brackets is 2 in the foregoing embodiment, the first and second spool brackets may be arranged into a W-shape or only one spool bracket may be used.

The foregoing description and drawings are merely illustrative and are not to be construed in a limiting sense. Various changes and modifications will become apparent to those of ordinary skill in the art. All such changes and modifications are seen to fall within the scope as defined by the appended claims.

What is claimed is:

1. A spool holder comprising:

a spool holder base to which a plurality of thread spools is attachable;

a support base having a pivoting member that is configured to support the spool holder base so that the spool holder base is swingable in a horizontal plane, and a thread guide mechanism including:

a thread guide member having a plurality of thread guide portions that are configured to guide, at a location higher than the thread spools, threads extending from the respective thread spools, the plurality of thread guide portions being lined substantially in a horizontal direction, and a support pillar that is configured to support the thread guide member on the support base, wherein:

the spool holder base is composed of two divided spool holder bases, each divided spool holder base being divided into a plurality of portions and including:

a first spool holder base on which a plurality of thread spools is placed so as to be horizontally lined, the first spool holder base having one end that is pivotally mounted on the pivoting member so that the first spool holder base is swingable;

a second spool holder base which is continuous to another end of the first spool holder base and on which a plurality of thread spools is placed so as to be horizontally lined, the second spool holder base having two ends; and a connection that is configured to connect one end of the second spool holder base to the other end of the first spool holder base so that each second spool holder base is swingable, each divided spool holder base is switchable between a storage position where the first and second spool holder bases are adjacent to each other so as to be substantially in parallel to each other in a lengthwise direction and a use position where the first spool holder base is swung from the storage position about the pivoting member and the second spool holder base is swung about the connection so that the first and the second spool holder bases are spread so as to be nonparallel to each other; and the two divided spool holder bases are disposed bilaterally symmetric about the support pillar and are constructed so that the first and second spool holder bases are arranged into an M-shape when being located at the use position.

2. The spool holder according to claim 1, further comprising a holding mechanism which holds the divided spool holder base at the use or storage position.

3. The spool holder according to claim 2, wherein the holding mechanism includes:

a limiting plate which is disposed so as to be movable substantially linearly in a predetermined direction to the support base and to which the other end of the second spool holder base located opposite the one end of the second spool holder so that the second spool holder base is swingable; and a locking unit which locks the limiting plate to the support base so that the limiting plate is disallowed to be released from a locked state.

4. A sewing machine provided with a spool holder comprising:

a spool holder base to which a plurality of thread spools is attachable;

a support base having a pivoting member that is configured to support the spool holder base so that the spool holder base is swingable in a horizontal plane, and a thread guide mechanism including:

a thread guide member having a plurality of thread guide portions that are configured to guide, at a location higher than the thread spools, threads extending from the respective thread spools, the plurality of thread guide portions being lined substantially in a horizontal direction, and a support pillar that is configured to support the thread guide member on the support base, wherein:

the spool holder base is composed of two divided spool holder bases, each divided spool holder base being divided into a plurality of portions and including:

a first spool holder base on which a plurality of thread spools is placed so as to be horizontally lined, the first spool holder base having one end that is pivotally mounted on the pivoting member so that the first spool holder base is swingable;

a second spool holder base which is continuous to another end of the first spool holder base and on which a plurality of thread spools is placed so as to be horizontally line, the second spool holder base having two ends; and a connection that is configured to connect one end of the second spool holder base to the other end of the first spool holder base so that the second spool holder base is swingable, each divided spool holder base is switchable between a storage position where the first and second spool holder bases are adjacent to each other so as to be substantially in parallel to each other in a lengthwise direction and a use position where the first spool holder base is swung from the storage position about the pivoting member and the second spool holder base is swung about the connection so that the first and the second spool holder bases are spread so as to be nonparallel to each other; and the two divided spool holder bases are disposed bilaterally symmetric about the support pillar and are constructed so that the first and second spool holder bases are arranged into an M-shape when being located at the use position.

* * * * *